US007082911B2

(12) United States Patent
Ezaki et al.

(10) Patent No.: US 7,082,911 B2
(45) Date of Patent: Aug. 1, 2006

(54) VALVE-DRIVING SYSTEM AND METHOD FOR INTERNAL COMBUSTION ENGINE, AND POWER OUTPUT APPARATUS

(75) Inventors: Shuichi Ezaki, Susono (JP); Toshiaki Asada, Mishima (JP); Kimitoshi Tsuji, Susono (JP); Yasushi Kusaka, Susono (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 21 days.

(21) Appl. No.: 10/896,949

(22) Filed: Jul. 23, 2004

(65) Prior Publication Data

US 2005/0028768 A1 Feb. 10, 2005

(30) Foreign Application Priority Data

Aug. 6, 2003 (JP) ..... 2003-288275

(51) Int. Cl.
*F01L 1/34* (2006.01)

(52) U.S. Cl. ..... 123/90.15; 123/90.17; 123/90.31; 123/347

(58) Field of Classification Search ..... 123/90.15, 123/90.16, 90.17, 90.18, 690, 90.27, 90.31, 123/90.6, 345, 347; 73/116, 117.3
See application file for complete search history.

(56) References Cited

U.S. PATENT DOCUMENTS

| | | | | |
|---|---|---|---|---|
| 5,873,335 | A | 2/1999 | Wright et al. | |
| 5,960,755 | A | 10/1999 | Diggs et al. | |
| 6,006,707 | A * | 12/1999 | Ito | 123/90.15 |
| 6,505,587 | B1 * | 1/2003 | Scheidt | 123/90.17 |
| 6,718,920 | B1 * | 4/2004 | Hoshino et al. | 123/90.15 |
| 2003/0005899 | A1 | 1/2003 | Scheidt | |

FOREIGN PATENT DOCUMENTS

| | | |
|---|---|---|
| DE | 101 16 707 A1 | 10/2002 |
| FR | 2 608 675 | 6/1988 |
| JP | A 59-68509 | 4/1984 |
| JP | A 2-259212 | 10/1990 |
| JP | A 8-177536 | 7/1996 |
| JP | A 10-169418 | 6/1998 |
| JP | A 2001-152820 | 6/2001 |

* cited by examiner

*Primary Examiner*—Thomas Denion
*Assistant Examiner*—Ching Chang
(74) *Attorney, Agent, or Firm*—Oliff & Berridge, PLC

(57) ABSTRACT

A valve-driving system for an internal combustion engine is provided with: an electric motor for generating a rotational driving force to drive a valve for intake or exhaust mounted on a cylinder in the internal combustion engine so as to open and close the valve in synchronization with a piston motion in the internal combustion engine; a transmitting device capable of changing between (i) a first condition to transmit therethrough the rotational driving force to the valve from said electric motor and (ii) a second condition to stop an opening or closing operation of the valve or to make the valve driven by a low lift amount; a judging device for judging whether or not synchronization between the opening or closing operation of the valve and the piston motion is abnormal; and a fail-safe device for changing said transmitting device to the second condition if it is judged by the judging device that the synchronization is abnormal.

12 Claims, 13 Drawing Sheets

VALVE-DRIVING SYSTEM AND METHOD FOR INTERNAL COMBUSTION ENGINE, AND POWER OUTPUT APPARATUS

BACKGROUND OF THE INVENTION

1. Field of the Invention

The present invention relates to a valve-driving system for driving an intake valve or an exhaust valve of an internal combustion engine.

2. Description of the Related Art

The intake valve and the exhaust valve of the conventional internal combustion engine are driven to be opened or closed by power taken out from a crankshaft of the internal combustion engine. Recently, however, it has been attempted to drive the intake valve and the exhaust valve by using an electric motor. For example, Japanese Patent Application Laying Open NO. Hei 8-177536 discloses a valve-driving apparatus for driving a camshaft by using a motor to open or close the intake valve.

Moreover, for example, Japanese Patent Application Laying Open NO. Hei 10-169418 discloses an electromagnetically driven valve mechanism for driving a valve body of the intake valve or the exhaust valve by an electromagnetic force, in a variable valve mechanism of the internal combustion engine which is capable of continuously varying an operating angle and a phase of the intake valve or the exhaust valve to control an intake air amount.

However, if the valve body is driven to be opened or closed by the electromagnetically driven valve mechanism, which is disclosed in the above-described Japanese Patent Application Laying Open NO. Hei 10-169418 or the like, or if the valve body is driven to be opened or closed by the rotation of a camshaft by the electric motor independently of the rotation of the crankshaft, which is disclosed in Japanese Patent Application Laying Open NO. Hei 8-177536 or the like, it is necessary to synchronize the valve-driving system with the rotation of the crankshaft, i.e. piston motion, highly accurately, as opposed to the conventional case where the opening or closing of the valve-driving is performed by the power taken out from the crankshaft. If they become out of synchronization greatly by a failure or at the moment of some motions, that possibly not only decreases the performance of the internal combustion engine, but also causes the collision of the valve body and the piston or the collision of the intake valve and the exhaust valve, consequently damaging the internal combustion engine, which is a technical problem.

On the other hand, in order to prevent this problem, it is also conceivable to design to provide a recess or escape portion or the like at the upper portion of the piston so as not to contact the valve body with the piston even in the largest lift condition. However, this is restricted in design in many cases by the shape of a combustion chamber. Even if the above design is realized, there is a technical problem that it is difficult to ensure a high compression ratio required for a diesel engine or the like.

SUMMARY OF THE INVENTION

It is therefore an object of the present invention to provide: a valve-driving system for an internal combustion engine which is capable of reducing a bad influence caused by an abnormality if there is the abnormality in synchronization control between the valve-driving system and the rotation of the crankshaft, for example, in the internal combustion engine having the valve-driving system for driving the valve body open or closed by the electric motor; and a power output apparatus provided with the valve-driving system and the internal combustion engine.

The above object of the present invention can be achieved by a first valve-driving system for an internal combustion engine provided with: an electric motor for generating a rotational driving force to drive a valve for intake or exhaust mounted on a cylinder in the internal combustion engine so as to open and close the valve in synchronization with a piston motion in the internal combustion engine; a transmitting device capable of changing between (i) a first condition to transmit therethrough the rotational driving force to the valve from the electric motor and (ii) a second condition to stop an opening or closing operation of the valve or to make the valve driven by a low lift amount; a judging device for judging whether or not synchronization between the opening or closing operation of the valve and the piston motion is abnormal; and a fail-safe device for changing the transmitting device to the second condition if it is judged by the judging device that the synchronization is abnormal.

According to the first valve-driving system of the present invention, in a normal case, the rotational driving force generated on the electric motor is transmitted to the valve through the transmitting device which is in the first condition or the normal condition and which includes, e.g., a lock pin, a rocker arm, a lost motion arm, or the like. Here, for example, the rotational driving force from the electric motor is converted into a linear motion by a link mechanism or a cam mechanism, and in the end, transmitted to the valve. This drives the valve in synchronization with the piston motion, which allows a normal intake and exhaust. The electric motor is used in the present invention, which facilitates the valve-driving system being constructed as a variable valve mechanism. Therefore, it is possible to enjoy various benefits by the variable valve mechanism.

Particularly, if the synchronization between the opening or closing operation of the valve and the piston motion becomes abnormal, the fact is judged or determined by the judging device which is provided with an Electronic Control Unit (ECU) or the like, for example. Then, the transmitting device is changed to the second condition thereof by the fail-safe device which is also provided with the ECU or the like, for example. Then, the opening or closing operation of the valve is stopped, or the valve is opened or closed by a low lift amount by the transmitting device which is in the second condition.

In general, if the synchronization between the opening or closing operation of the valve and the piston motion is abnormal, it is also conceivable to stop an electromagnetically driven valve and the electric motor or to control the electromagnetically driven valve to the low-lift side. However, it is difficult to perform such a control in a moment during revolution of the engine. If the control is daringly performed, that may increase the output and size of a motor of a drive unit. On the other hand, if an electrical valve stopping mechanism is incorporated into the electromagnetically driven valve which directly drives the intake valve or the exhaust valve, the size or weight of the entire mechanism and the inertial mass of a valve-train system increase, so that the output power of the drive unit is required more. On the contrary, if the transmitting device has a structure that is able to allow elements to be linked or separated mechanically, as in the present invention, it is relatively easy to improve responsiveness. The improvement of the responsiveness makes it possible to stop the valve opening or closing operation, or to drive the valve by a low lift amount during one cycle of the engine, for example. Therefore, since it is possible to prevent the valve which is out of synchronization from colliding with the piston and breaking down, it is much more useful in practice.

As described above, according to the first valve-driving system of the present invention, it is possible to properly perform the fail-safe processing even if there is an abnormality in the control of synchronization between the valve-driving system and the rotation of the crankshaft in the internal combustion engine (i.e., the synchronization control) having the valve-driving system for driving the intake valve or exhaust valve open or closed by using the electronic motor, for example. Thus, it is possible to reduce the bad influence caused by the abnormality. In particular, a safe run or evacuation run becomes possible by applying the present invention to an internal combustion engine mounted on an automobile.

In one aspect of the first valve-driving system of the present invention, the transmitting device is provided with: a rocker arm connected to the valve; a lost motion arm which can be linked to the rocker arm in the first condition and which is connected to the electric motor; and a linkage-separating device for separating the lost motion arm from the rocker arm, by an oil pressure which is caused by driving power of the internal combustion engine or an electromagnetic force which is not caused by the power, in the second condition.

According to this aspect, if it is judged that the synchronization is abnormal, the lost motion arm is separated from the rocker arm by the linkage-separating device which is constructed from a hydraulic or electromagnetic actuator or the like, for example. By this, the transmitting device is changed to the second condition thereof. Therefore, by using the relatively simple mechanical structure, it is possible to quickly stop the opening or closing operation of the valve or to quickly drive the valve open or closed by a low lift amount.

The above object of the present invention can be also achieved by a second valve-driving system for an internal combustion engine provided with: an electric motor for generating a rotational driving force to drive a valve for intake or exhaust mounted on a cylinder in the internal combustion engine so as to open and close the valve in synchronization with a piston motion in the internal combustion engine; a rotation-number determining device for determining a target number of rotations of the internal combustion engine; a rotation-number detecting device for detecting an actual number of rotations of the internal combustion engine; and a judging device for judging whether or not synchronization between the an opening or closing operation of the valve and the piston motion is abnormal, on the basis of a difference in quantity between the determined target number of rotations and the detected actual number of rotations.

According to the second valve-driving system of the present invention, in the normal case, the rotational driving force generated on the electric motor is transmitted to the valve. Here, if the synchronization between the opening or closing operation of the valve and the piston motion becomes abnormal, the fact is judged or determined by the judging device which is provided with the ECU or the like, for example. In particular, the judgment of whether or not the synchronization is abnormal is performed on the basis of the difference in quantity between the target number of rotations of the internal combustion engine determined by the rotation-number determining device and the actual number of rotations of the internal combustion engine detected by the rotation-number detecting device.

In general, the motion of the valve-train system is controlled so as to synchronize crank rotation (the piston motion) with the motion of the valve-train system (cam rotation), by measuring them with sensors. However, in some cases, they possibly become out of synchronization because of the increase in friction, and the deterioration and failure of motors and sensors caused by the breaking of wire and degradation or the like. Moreover, they possibly become out of synchronization because of the increase in friction and the failure of a piston axis and the crankshaft or the like. Therefore, it is difficult or impossible in practice to accurately judge whether or not the synchronization is abnormal by measuring them in reliance on the output of the sensors, as described above. Consequently, unnecessary or harmful fail-safe processing is possibly performed at a wrong timing in accordance with the inaccurate judgment result. Alternatively, the fail-safe processing is possibly not performed at a timing at which the fail-safe processing is to be performed. On the contrary, as in the above-described present invention, it is possible to judge extremely accurately whether or not the synchronization is abnormal on the basis of the difference in quantity between the target number of rotations and the actual number of rotations. Thus, it is possible to perform the proper fail-safe processing at a proper timing. As a result, since it is possible to prevent the valve which is out of synchronization from colliding with the piston and breaking down, it is much more useful in practice.

As described above, according to the second valve-driving system of the present invention, it is possible to judge the abnormality extremely accurately even if there is the abnormality in the synchronization control between the valve-driving system and the rotation of the crankshaft, for example, in the internal combustion engine having the valve-driving system for driving the intake valve or exhaust valve open or closed by using the electronic motor. Thus, it is possible to reduce the bad influence caused by the abnormality by performing various fail-safe processing in accordance with the judgment result. In particular, a safe run or evacuation run becomes possible by applying the present invention to an internal combustion engine mounted on an automobile.

In one aspect of the first valve-driving system of the present invention, the first valve-driving system is further provided with: a rotation-number determining device for determining a target number of rotations of the internal combustion engine; and a rotation-number detecting device for detecting an actual number of rotations of the internal combustion engine, the judging device judging whether or not the synchronization between the opening or closing operation of the valve and the piston motion is abnormal, on the basis of a difference in quantity between the determined target number of rotations and the detected actual number of rotations.

According to this aspect, the rotation-number determining device, which is constructed from various rotation-number sensors and the ECU having a calculation function or the like, determines the target number of rotations N from measured data of actual rotation in the crankshaft (or measured data of the piston motion) Ncrk and required torque or the like, for example. The rotation-number detecting device, which includes the various rotation-number sensors, detects the number of rotations of a cam or a link Ncam or the like. Therefore, the judging device is capable of judging relatively quickly and accurately on the basis of the difference in quantity between them.

In another aspect of the second valve-driving system of the present invention, the judging device judges that the synchronization is abnormal if the difference in quantity reaches to or exceeds a predetermined threshold value.

According to this aspect, a difference ΔN1 between the target number of rotations N and the actual number of rotations of the cam (or the link) for the intake valve Ncam1 is compared with a predetermined threshold value ΔN, wherein N is determined from the actual number of rotations of the crankshaft Ncrk and the required torque or the like. Alternatively, a difference ΔN2 between the target number of rotations N and the actual number of rotations of the cam (or the link) for the exhaust valve Ncam2 is compared with the predetermined threshold value ΔN. Then, as a result of the judgment, it is judged whether the synchronization is abnormal or normal. Thus, it is possible to judge relatively quickly and accurately.

In another aspect of the second valve-driving system of the present invention, the rotation-number detecting device is provided with a cam-rotation-number measuring device for measuring the number of rotations of a cam of the internal combustion engine, and the rotation-number determining device is provided with a target-cam-rotation-number calculating device for calculating the target number of rotations on the basis of a required torque as well as the number of engine revolutions or the number of rotations of a crankshaft of the internal combustion engine.

According to this aspect, the judging device is capable of judging relatively quickly and accurately on the basis of the number of rotations of the cam, which is measured by the cam-rotation-number measuring device, and the target number of rotations, which is calculated by the target-cam-rotation-number calculating device on the basis of the required torque as well as the number of engine revolutions or the number of rotations of the crankshaft.

In another aspect of the first or second valve-driving system of the present invention, the internal combustion engine has a plurality of cylinders, and the valve-driving system is provided for each of the plurality of cylinders.

According to this aspect, in the internal combustion engine having a plurality of cylinders, for each of the plurality of cylinders, it is possible to perform the fail-safe processing and judge whether the synchronization is abnormal, independently of each other. Therefore, it is also possible to perform such an evacuation run that the operation is stopped only for a cylinder in which the synchronization is abnormal.

The above object of the present invention can be also achieved by a first valve-driving method in a valve-driving system for an internal combustion engine provided with: an electric motor for generating a rotational driving force to drive a valve for intake or exhaust mounted on a cylinder in the internal combustion engine so as to open and close the valve in synchronization with a piston motion in the internal combustion engine; and a transmitting device capable of changing between (i) a first condition to transmit therethrough the rotational driving force to the valve from said electric motor and (ii) a second condition to stop an opening or closing operation of the valve or to make the valve driven by a low lift amount, the valve-driving method provided with: a driving process of generating the driving force by the electric motor; a judging process of judging whether or not synchronization between the opening or closing operation of the valve and the piston motion is abnormal; and a fail-safe process of changing the transmitting device to the second condition if it is judged by the judging process that the synchronization is abnormal.

According to the first valve-driving method of the present invention, as in the case of the above-described first valve-driving system of the present invention, if the synchronization between the opening or closing operation of the valve and the piston motion becomes abnormal, the fact is judged or determined by the judging process. Then, the transmitting device is changed to the second condition thereof by the fail-safe process. Then, the opening or closing operation of the valve is stopped, or the valve is opened or closed by a low lift amount by the transmitting device which is in the second condition. Therefore, according to the first valve-driving method of the present invention, it is possible to properly perform the fail-safe processing even if there is an abnormality in the synchronization control between the valve-driving system and the rotation of the crankshaft, for example, in the internal combustion engine having the valve-driving system for driving the intake valve or exhaust valve open or closed by using the electronic motor. Thus, it is possible to reduce the bad influence caused by the abnormality.

The above object of the present invention can be also achieved by a second valve-driving method in a valve-driving system for an internal combustion engine provided with: an electric motor for generating a rotational driving force to drive a valve for intake or exhaust mounted on a cylinder in the internal combustion engine so as to open and close the valve in synchronization with a piston motion in the internal combustion engine, the valve-driving method provided with: a rotation-number determining process of determining a target number of rotations of the internal combustion engine; a rotation-number detecting process of detecting an actual number of rotations of the internal combustion engine; and a judging process of judging whether or not synchronization between the an opening or closing operation of the valve and the piston motion is abnormal, on the basis of a difference in quantity between the determined target number of rotations and the detected actual number of rotations.

According to the second valve-driving method of the present invention, as in the case of the above-described second valve-driving system of the present invention, if the synchronization between the opening or closing operation of the valve and the piston motion becomes abnormal, the fact is judged or determined by the judging process. In particular, the judgment of whether or not the synchronization is abnormal is performed on the basis of the difference in quantity between the target number of rotations of the internal combustion engine determined by the rotation-number determining process and the actual number of rotations of the internal combustion engine detected by the rotation-number detecting process. Therefore, according to the second valve-driving method of the present invention, it is possible to judge the abnormality extremely accurately even if there is the abnormality in the synchronization control between the valve-driving system and the rotation of the crankshaft, for example, in the internal combustion engine having the valve-driving system for driving the intake valve or exhaust valve open or closed by using the electronic motor. Thus, it is possible to reduce the bad influence caused by the abnormality by performing various fail-safe processing in accordance with the judgment result.

The above object of the present invention can be achieved by a power output apparatus provided with: an internal combustion engine; and the above-described first or second valve-driving system of the present invention (including its various aspects).

According to the power output apparatus of the present invention, it is provided with the above-described first or second valve-driving system of the present invention. Thus, even if there is an abnormality in the synchronization control between the valve-driving system and the rotation of the crankshaft, it is possible to reduce the bad influence caused by the abnormality. In particular, a safe run or evacuation run becomes possible by applying the present invention to an automobile.

The nature, utility, and further features of this invention will be more clearly apparent from the following detailed description with reference to preferred embodiments of the invention when read in conjunction with the accompanying drawings briefly described below.

BRIEF DESCRIPTION OF THE DRAWINGS

FIG. 11 is a conceptual diagram showing an ECU for controlling the internal combustion engine and the valve-driving system for the internal combustion engine associated with the present invention, various sensors, various actuators, or the like;

DETAILED DESCRIPTION OF THE PREFERRED EMBODIMENTS

The specific embodiments of the valve-driving system for the internal combustion engine associated with the present invention will be explained with reference to the drawings. For convenience, a first explanation is about a mechanical portion including the "electric motor" and the "transmitting device" associated with the present invention, for each of the valve-driving systems in the first to fourth embodiments (refer to FIG. 1 to FIG. 10). Then, a second explanation is about a specific detection method of detecting an abnormality in the synchronization control, and a specific stop controlling method of controlling the stop of the intake valves or the exhaust valves in an abnormal case of the synchronization control, or the like, which are common to the first to fourth embodiments (refer to FIG. 11 to FIG. 13). The above methods use the Electronic Control Unit (ECU), which constitutes one example of the "judging device" and the "fail-safe device" associated with the present invention.

Incidentally, in the embodiments below, if there is an abnormality in the synchronization between the piston motion and the motion of the intake valves or the exhaust valves, which are synchronously controlled, for some reasons such as a failure, that is merely referred to as "in the abnormal case of the synchronization control", as occasion demands. Such an abnormality in synchronization is merely referred to as the "abnormality in the synchronization control", as occasion demands.

(First Embodiment)

The structure and operation of the valve-driving system for the internal combustion engine in the first embodiment will be explained in detail with reference to FIG. 1 to FIG. 5.

Figure 1:
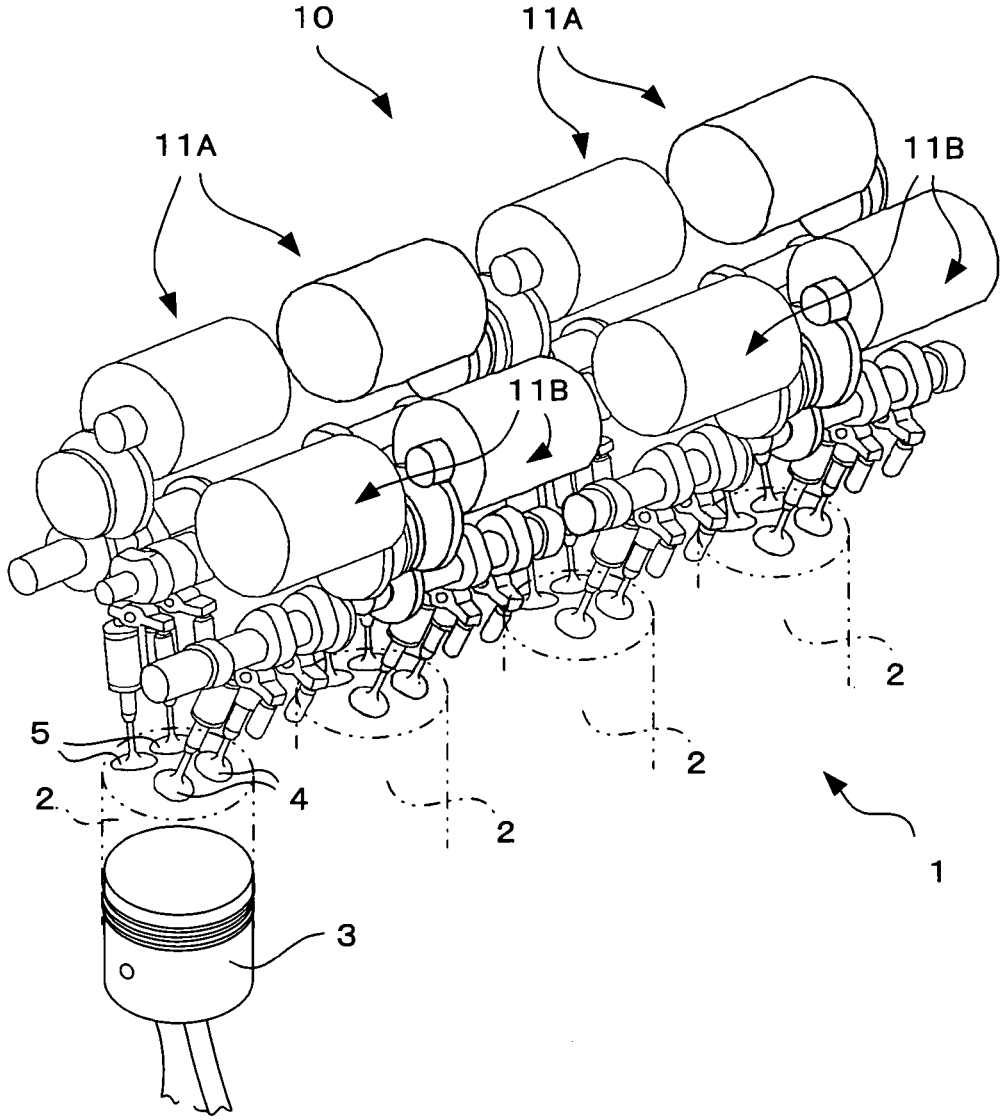
FIG. 1 is a perspective view showing the entire structure of an internal combustion engine in which a valve-driving system associated with a first embodiment of the present invention is incorporated.

Firstly, with reference to FIG. 1, the entire structure of the valve-driving system for the internal combustion engine associated with the first embodiment will be explained. FIG. 1 shows the entire structure of the internal combustion engine in which the valve-driving system associated with the first embodiment is incorporated.

An internal combustion engine 1 is constructed as a multi-cylinder in-line gasoline engine in which a plurality of (four in FIG. 1) cylinders 2 are disposed in one direction and in which a piston 3 is attached to each cylinder 2 movably in the vertical direction (up and down). Two intake valves 4 and two exhaust valves 5 are disposed on top of each cylinder 2. The intake valves 4 and the exhaust valves 5 are driven to be opened or closed in a valve-driving system 10 in synchronization with the vertical motion of the piston 3. By this, the intake to the cylinder 2 and the exhaust from the cylinder 2 are performed.

The valve-driving system 10 is provided with: valve-driving apparatuses 11A, each of which is disposed on the exhaust side of relative one of the cylinders 2; and valve-driving apparatuses 11B, each of which is disposed on the intake side of relative one of the cylinders 2. Each of the valve-driving apparatuses 11A and 11B drives the exhaust valves 5 or the intake valves 4 by using a cam. The structures of the valve-driving apparatuses 11A are identical each other, and the structures of the valve-driving apparatuses 11B are identical each other. Incidentally, the plurality of valve-driving apparatuses 11A may be constructed to drive the valves independently of each other, such as stopping only one cylinder 2 or the like, or to drive the valves in conjunction with each other. In the same manner, the plurality of valve-driving apparatuses 11B may be constructed to drive the valves independently of each other, or to drive the valves in conjunction with each other.

Figure 2:
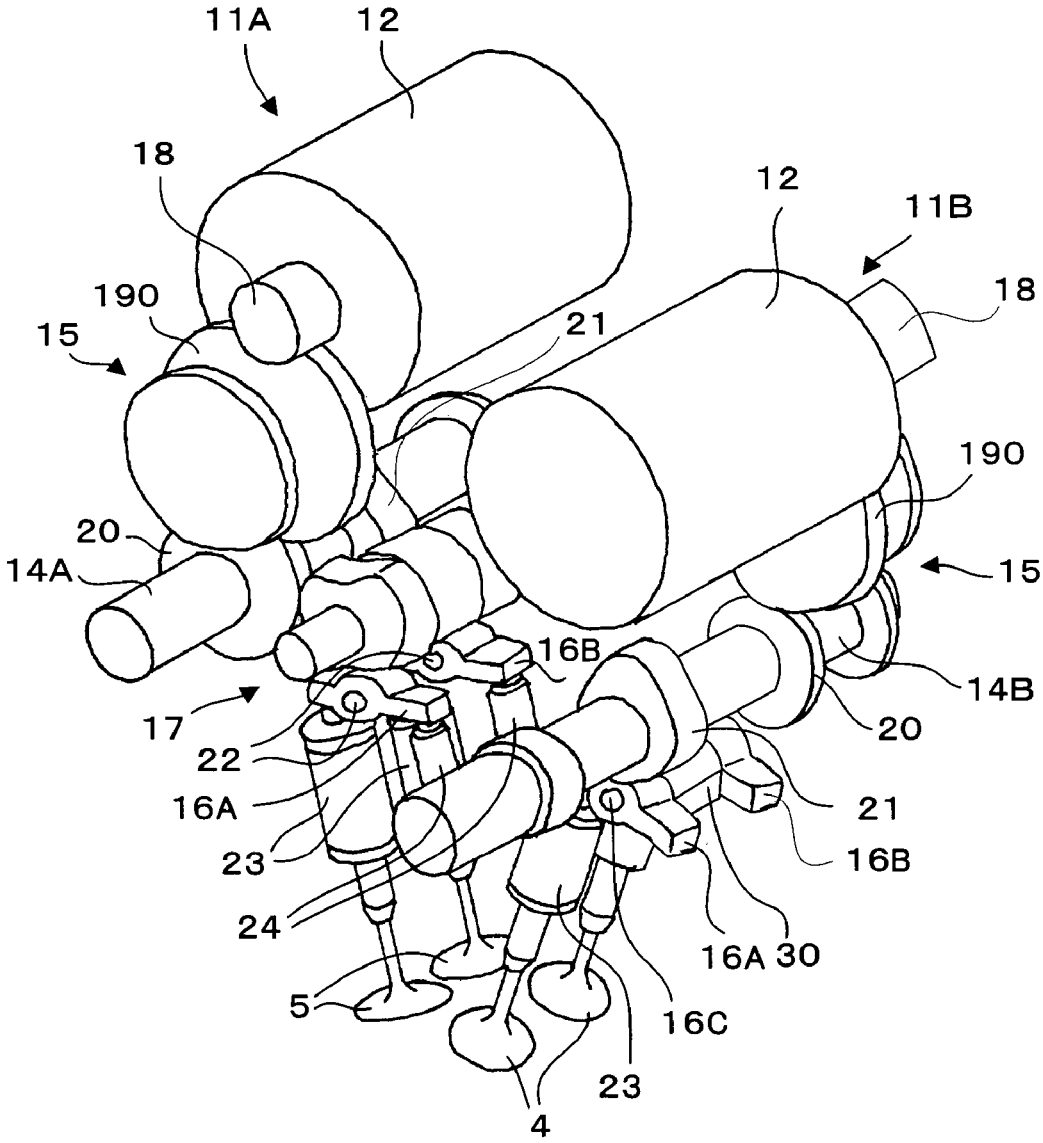
FIG. 2 is a perspective view showing the partial structure of the internal combustion engine in which the valve-driving system associated with the first embodiment of the present invention is incorporated, i.e. a valve-driving apparatus for one cylinder.

Next, with reference to FIG. 2, the partial structure of the internal combustion engine associated with the first embodiment, i.e. the valve-driving apparatus for one cylinder, will be explained. FIG. 2 shows the partial structure of the internal combustion engine in which the valve-driving system associated with the first embodiment is incorporated, i.e. the valve-driving apparatus for one cylinder.

As shown in FIG. 2, the valve-driving apparatus 11A for exhaust and the valve-driving apparatus 11B for intake are provided for one cylinder 2 in pairs. Incidentally, the valve-driving apparatuses 11A and 11B have structures similar to each other. At first, the valve-driving apparatus 11B on the intake side will be explained.

The valve-driving apparatus 11B on the intake side includes an electric motor 12 (hereinafter merely referred to as a "motor 12", as occasion demands) and is constructed to convert the rotational motion of the motor 12 into linear motion, i.e., the linear opening or closing motion of the intake valves 4. A DC brushless motor or the like, which is capable of controlling a rotational speed, is used for the motor 12. A position detection sensor, such as a resolver and a rotary encoder, for detecting its rotational position is built in the motor 12.

The valve-driving apparatus 11B is provided with: one camshaft 14B; a gear train for transmitting the rotational motion of the motor 12 to the camshaft 14B; rocker arms 16A and 16B for driving the intake valves 4; and a lost motion arm 30 disposed between the camshaft 14B and the rocker arms 16A and 16B. The camshaft 14B is provided independently for each cylinder 2. In other words, the camshaft 14B is separated for each cylinder 2. The gear train 15 transmits the rotation of a motor gear 18, which is mounted on an output shaft (not illustrated) of the motor 12, through an intermediate gear 190 to a cam drive gear 20, which is integrated with the camshaft 14B, and rotates the camshaft 14B in synchronization with the motor 12.

A single high-lift cam 21 is disposed on the camshaft 14B rotationally in one body. The high-lift cam 21 is formed as one type of a plate cam in which one portion of a base circle coaxial with the camshaft 14B swells. The profiles (or outer circumferential outlines) of the high-lift cams 21 are mutually identical among all the valve-driving apparatuses 11B. The profile of the high-lift cam 21 is designed not to generate a negative curvature along the entire periphery of the high-lift cam 21, i.e., to make a convex curved surface outward in the radial direction.

The rocker arms 16A and 16B are swingably or oscillatably provided, with a rocker arm shaft 16C as the center. An elastic force is applied by a valve spring 23 to the intake valves 4 to the side of the rocker arms 16A and 16B, by which the intake valves 4 are stuck to a valve seat (not-illustrated) of an intake port, and the intake port is closed.

On the other hand, as shown in FIG. 2, the valve-driving apparatus 11A on the exhaust valves 5 side is provided with: a cam 21 disposed on a camshaft 14A in the same manner as in the valve-driving apparatus 11B; and a valve-characteristics adjusting mechanism 17. The cam 21 drives rocker arms 16A and 16B through the valve-characteristics adjusting mechanism 17. Incidentally, the valve-characteristics adjusting mechanism 17 may be provided for the valve-driving apparatus 11B on the intake valves 4 side.

As in the case of the intake side, the rocker arms 16A and 16B are also swingably or oscillatably provided, with a rocker arm shaft 16C as the center. An elastic force is applied by a valve spring 23 to the exhaust valves 5 to the side of the rocker arms 16A and 16B, by which the exhaust valves 5 are stuck to a valve seat (not-illustrated) of an exhaust port, and the exhaust port is closed. The other end portions of the rocker arms 16A and 16B are in contact with adjusters 24. The adjusters 24 push up the other end portion of the rocker arms 16A and 16B, by which one end portions of the rocker arms 16A and 16B are maintained to be in contact with the upper end portions of the exhaust valves 5.

The valve-characteristics adjusting mechanism 17 functions as a mediate device for transmitting the rotational motion of the cam 21 to the rocker arms 16A and 16B as oscillatory motion and also functions as a lift amount/operating angle changing device for changing a lift amount and an operation angle of the exhaust valves 5 by changing a correlation between the rotational motion of the cam 21 and the oscillatory motion of the rocker arms 16A and 16B.

The other parts of the valve-driving apparatus 11A is in common with the valve-driving apparatus 11B, and the explanation for the common parts will be omitted.

With respect to the exhaust valves 5, the phase and operating angle thereof can be also variously changed by variously changing a drive speed of the camshaft 14B by using the motor 12 of the valve-driving apparatus 11B.

The valve-driving apparatus 11A is also provided independently for each cylinder 2, and the camshaft 14A is also independent for each cylinder 2. Thus, it is possible to set the operational characteristics of the exhaust valves 5 to be in the optimum condition independently for each cylinder 2. This makes it possible to enhance the flexibility about the operational characteristics of each exhaust valve 5 more than ever.

Incidentally, in the valve-driving apparatus 11B on the intake side, it is possible to change the lift amount of the intake valves 4 by stopping the motor 12 while the high-lift cam 21 pushes down the rocker arms 16A and 16B through the lost motion arm 30 and by reversing the camshaft 14B from the stop position. The largest lift amount in that case is limited to a lift amount in the case where a cam nose of the high-lift cam 21 goes over a not-illustrated roller of the lost motion arm 30. Such control of the lift amount by the reverse rotation of the motor 12 can be also performed on the valve-driving apparatus 11A on the exhaust side. The mechanism associated with the lost motion arm 30 may be provided on the valve-driving apparatus 11A on the exhaust valve 5 side.

Figure 3:
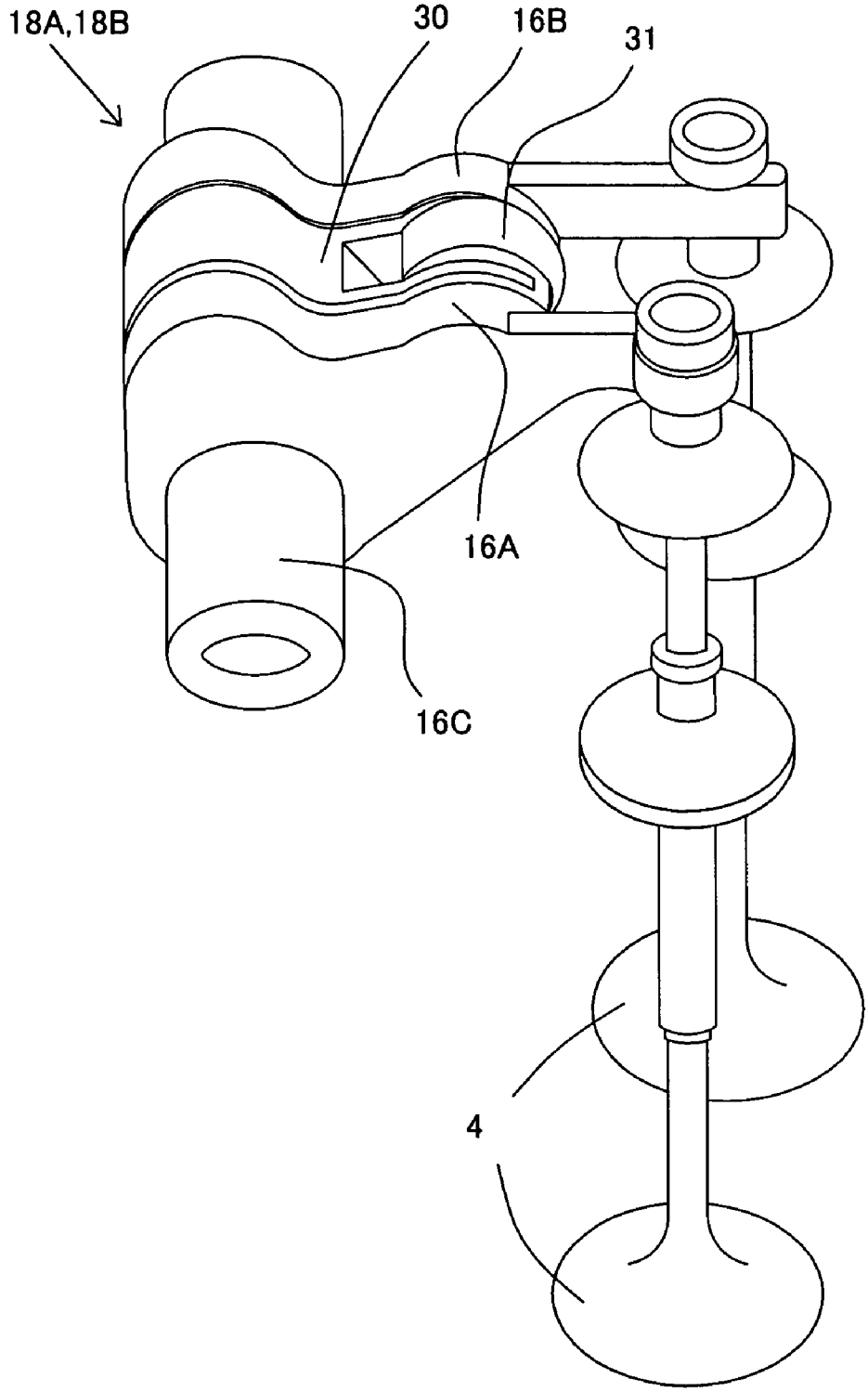
FIG. 3 is a perspective view showing the constituent elements of the valve-driving apparatus associated with the first embodiment of the present invention, i.e. rocker arms, a lost motion arm, and intake valves.
Figure 4:
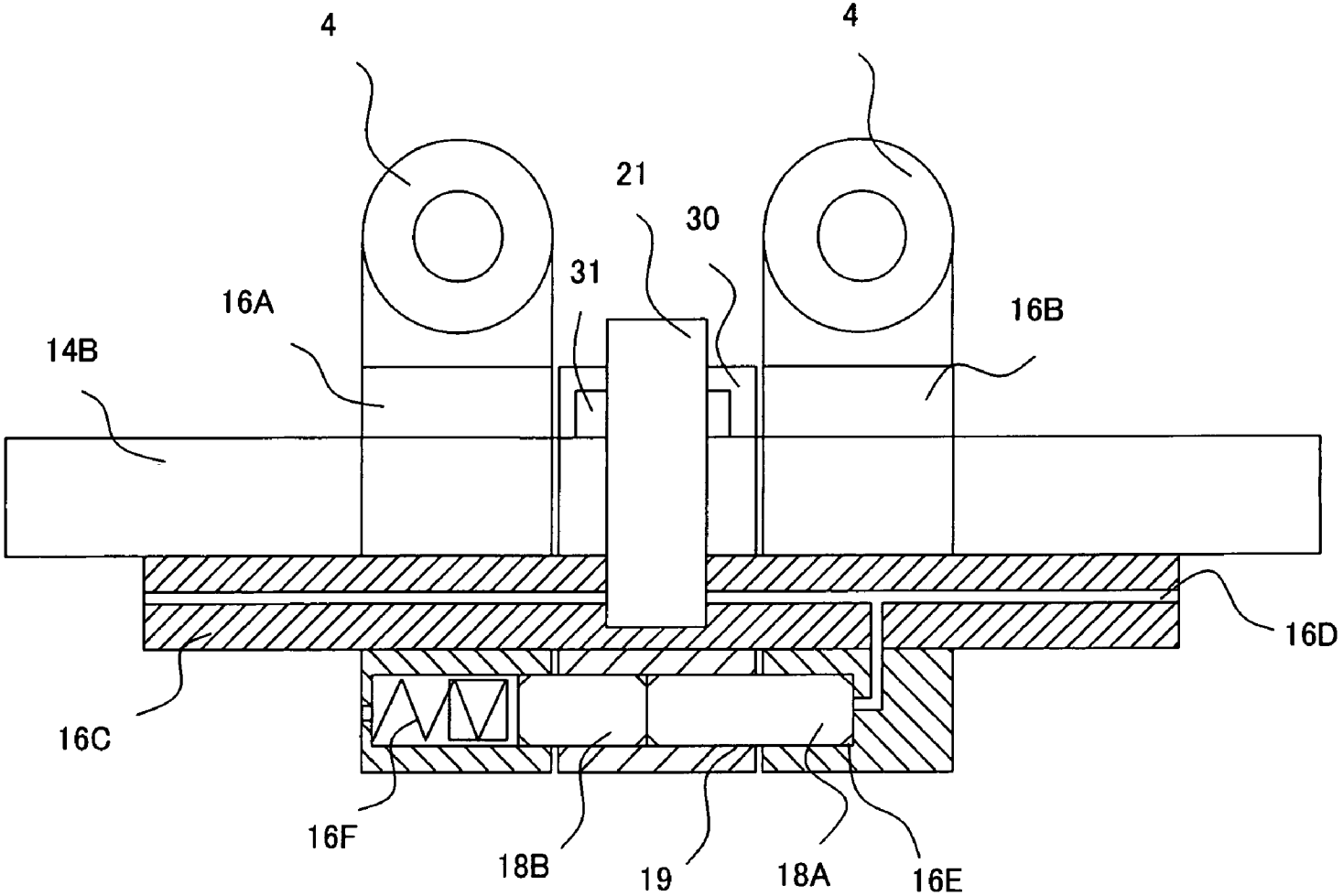
FIG. 4 is a schematic cross sectional view showing the structure, such as the rocker arm, the lost motion arm, and a high-lift cam, in a normal case of the valve-driving apparatus associated with the first embodiment of the present invention.

Next, with reference to FIG. 3 and FIG. 4, the structure of the valve-driving apparatus associated with the first embodiment will be explained in detail. FIG. 3 shows the constituent elements of the valve-driving apparatus associated with the first embodiment, i.e. the rocker arms, the lost motion arm, and the intake valves. FIG. 4 schematically shows the structure, such as the rocker arm, the lost motion arm, and the high-lift cam, in the normal case of the valve-driving apparatus associated with the first embodiment.

The valve-driving apparatus associated with the first embodiment shown in FIG. 3 and FIG. 4 is broadly provided with: the rocker arms 16A and 16B; the lost motion arm 30; the high-lift cam 21; and the intake valves 4.

The rocker arms 16A and 16B basically have a function of opening or closing the intake valves 4 or the exhaust valve 5. They are separated and positioned in parallel on the both sides of the lost motion arm 30 described later on the valve-driving apparatus associated with the first embodiment. Both of the rocker arms 16A and 16B do not abut on the high-lift cam 21 and are swingably or oscillatably disposed, with the rocker arm shaft 16C as a fulcrum. Inside both of the rocker arms 16A and 16B, there is an linkage hole 19 which is coaxially disposed and with which two lock pins 18A and 18B described later can be linked. Inside the linkage hole 19 of the rocker arm 16A, there is a return spring 16F described later. Inside the rocker arm 16B, there is a hydraulic chamber 16E communicated with the linkage hole 19. Inside both of the rocker arms 16A and 16B, there is a channel 16D for lubricating oil communicated with the hydraulic chamber 16E.

The lost motion arm 30 is positioned between both of the rocker arms 16A and 16B, and provided with a roller 31 in contact with the high-lift cam 21 described later. Particularly, the lost motion arm 30 abuts on a not-illustrated lost motion spring which makes lost motion possible. The lost motion arm 30 is always in contact with the high-lift cam 21 through the roller 31, by an elastic force of the lost motion spring. The lost motion arm 30 is capable of oscillating, independently of the rocker arms 16A and 16B with the rocker arm shaft 16C as the fulcrum, or in conjunction with them in one body. Inside the lost motion arm 30, there is the above-described coaxially disposed linkage hole 19 for linking the lock pins 18A and 18B therewith. Incidentally, together with the linkage hole 19, the lock pins 18A and 18B are disposed in the axial direction of the rocker arm shaft 16C inside a bulging portion shown with an arrow in FIG. 3. Inside the lost motion arm 30, there is the above-described channel 16D for lubricating oil communicated with the hydraulic chamber 16E.

Each of the two intake valves 4 is disposed to abut on respective one of the rocker arms 16A and 16B and to be in conjunction with them.

The high-lift cam 21 is disposed to rotate around the camshaft 14B and to be in contact with the roller 31 of the lost motion arm 30. The high-lift cam 21 is set to have a cam profile which causes high torque in a high speed rotation range of the internal combustion engine. The high-lift cam 21 is, for example, a high-speed type output cam having a lift amount and a lift duration or period (an operating angle) larger than those of a typical cam.

Figure 5:
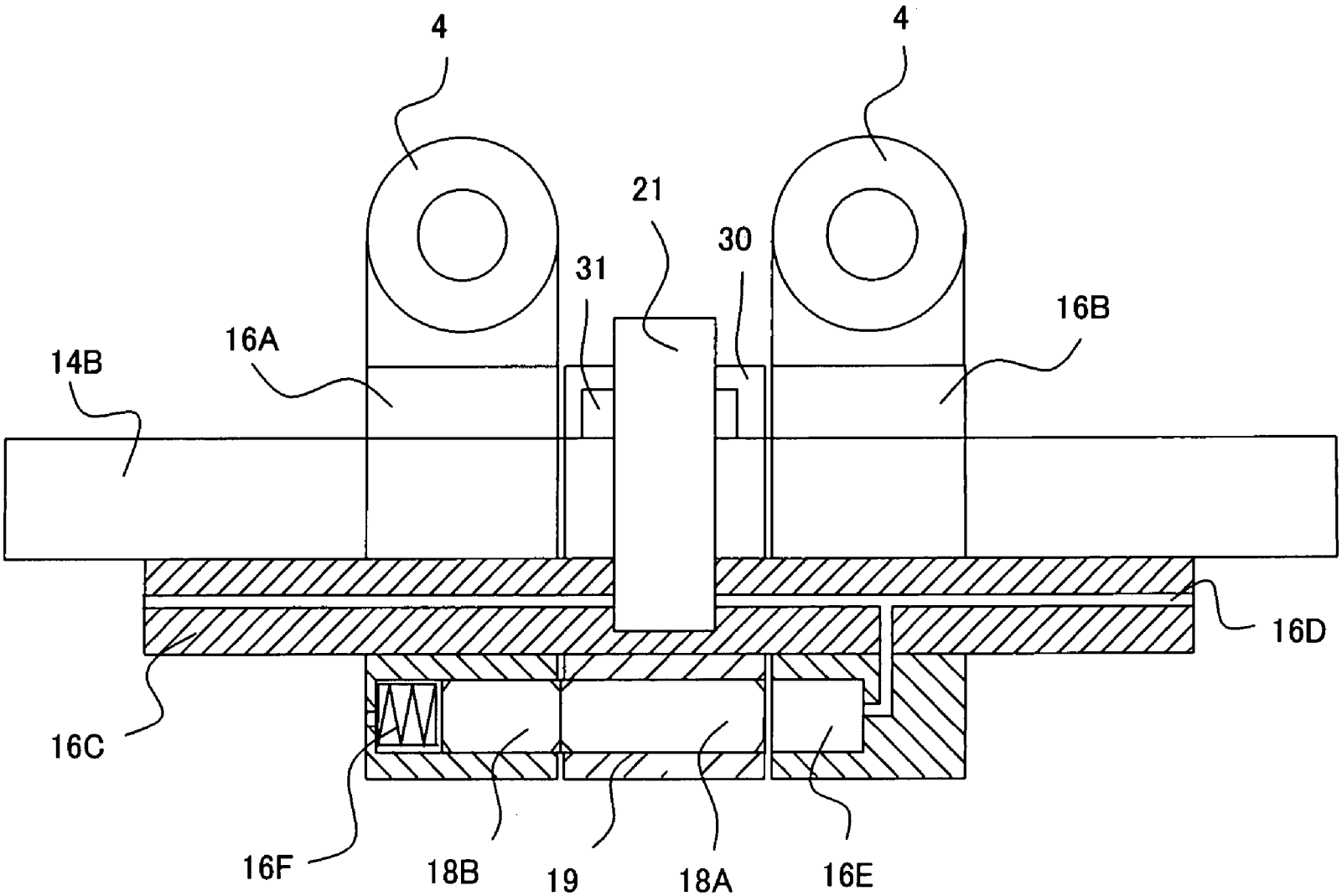
FIG. 5 is a schematic cross sectional view showing the structure, such as the rocker arm, the lost motion arm, and the high-lift cam, in an abnormal case of synchronization control of the valve-driving apparatus associated with the first embodiment of the present invention.

Next, with reference to FIG. 5 and the above-described FIG. 4, the operation of the valve-driving apparatus associated with the first embodiment will be explained in detail. FIG. 5 schematically shows the structure, such as the rocker arm, the lost motion arm, the intake valve, and the high-lift cam, in the abnormal case of synchronization control of the valve-driving apparatus associated with the first embodiment.

As shown in FIG. 4 and FIG. 5, the linkage hole 19 is formed in the axial direction of the rocker arm shaft 16C, at an oscillation part which is a predetermined distance away from the rocker arm shaft 16C, in each of the above-described rocker arms 16A and 16B and the lost motion arm 30. The two in total of the rock pins 18A and 18B are inserted in the linkage hole 19, and the rock pins 18A and 18B can slide in the direction of the rocker arm shaft 16C in response to an operating oil pressure.

Incidentally, one example of the "transmitting device" associated with the present invention is constructed from: the rocker arms 16A and 16B; the lost motion arm 30; the linkage hole 19; the lock pins 18A and 18B, which are described above; and various actuators for generating an oil pressure and an electromagnetic force which will be described later. Among them, the "linkage-separating device" associated with the present invention is constructed from the various actuators for generating an oil pressure and an electromagnetic force.

As shown in FIG. 4, in the normal case, the lock pin 18B is linked to the linkage hole 19 inside the rocker arm 16A and the lost motion arm 30 by an elastic force of a return spring 16F. At the same time, the lock pin 18A is pushed by the lock pin 18B and linked to the linkage hole 19 inside the lost motion arm 30 and the rocker arm 16B. Then, both of the rocker arms 16A and 16B, and the lost motion arm 30 are connected and unified in one body. Thus, the rotational motion of the high-lift cam 21 is transmitted to the intake valves 4 or the exhaust valves 5 through the roller 31 mounted on the lost motion arm 30 and both of the rocker arms 16A and 16B, by which it is possible to open or close the intake valves 4 or the exhaust valves 5.

Namely, in the normal case, the lost motion arm 30 and the rocker arms 16A and 16B on the both sides thereof are connected and unified in one body. Then, at a valve timing according to the cam profile of the high-lift cam 21, it is possible to open or close the intake valves 4 or the exhaust valves 5.

On the other hand, as shown in FIG. 5, "in the abnormal case of the synchronization control", which is the case where there is an abnormality in the synchronization between the motion of the piston 3 and the motion of the intake valves 4 or the exhaust valves 5, the various actuators for generating an oil pressure are operated under the control of the ECU, which is one example of the "judging device" and the "fail-safe device" associated with the present invention as descried later, and pressure oil is led to the hydraulic chamber 16E in which the lock pin 18A is stored through the channel 16D. The two lock pins 18A and 18B are pushed to the left direction by a predetermined amount against the elastic force of the return spring 16F, and the lock pin 18A is just stored into the linkage hole 19 of the lost motion arm 30. In the first embodiment, the abnormality in the synchronization control means such a condition that a difference in quantity between the number of rotations of the camshaft and the target number of rotations of the camshaft, which is obtained from the number of rotations of the crankshaft and the required torque of the internal combustion engine, is greater than a predetermined threshold value. Particularly, the predetermined threshold value may be determined with the phase of the cam and the lift amount as parameters.

Incidentally, the length of the lock pin 18A is designed to be almost or completely the same as the width of the lost motion arm 30. The lock pin 18B which is pushed to the left direction by the lock pin 18A is just stored into the rocker arm 16A. By this, the connection between the lost motion arm 30 and the rocker arms 16A and 16B on the both sides thereof is released, and the rotational motion of the high-lift cam 21 is absorbed into the not-illustrated lost motion spring which supports the lost motion arm 30 and not transmitted to the locker arms 16A and 16B which abut on the intake valves 4 or the exhaust valves 5. Thus, the opening or closing of the intake valves 4 or the exhaust valves 5 is stopped.

As described above, according to the valve-driving apparatus in the first embodiment, it is possible to stop the intake valves or the exhaust valves quickly and at a proper timing if there is an abnormality in the synchronization control, which allows a safe evacuation run.

Figure 11:
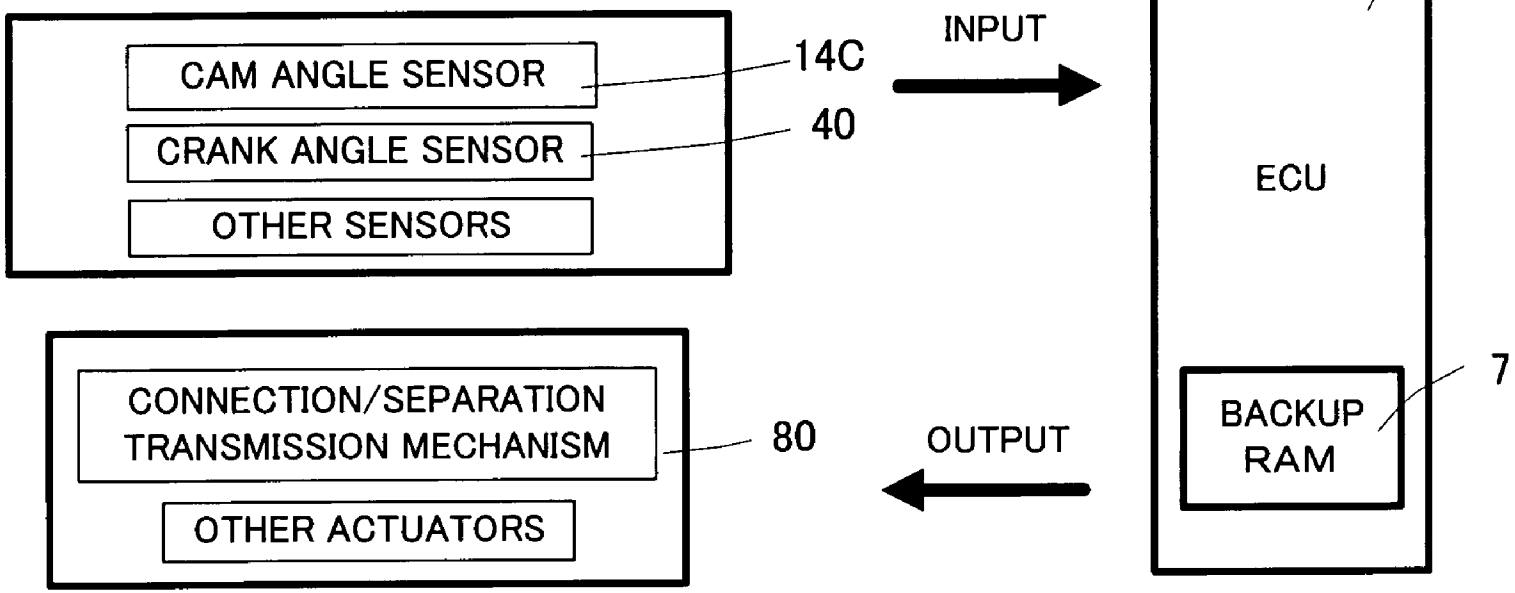

Incidentally, a specific detection method of detecting an abnormality in the synchronization control as well as a specific stop controlling method of controlling the stop of the intake valves or the exhaust valves in the abnormal case of the synchronization control in the above-explained first embodiment will be described later (refer to FIG. 11 and FIG. 12 or the like).

(Second Embodiment)

Figure 6:
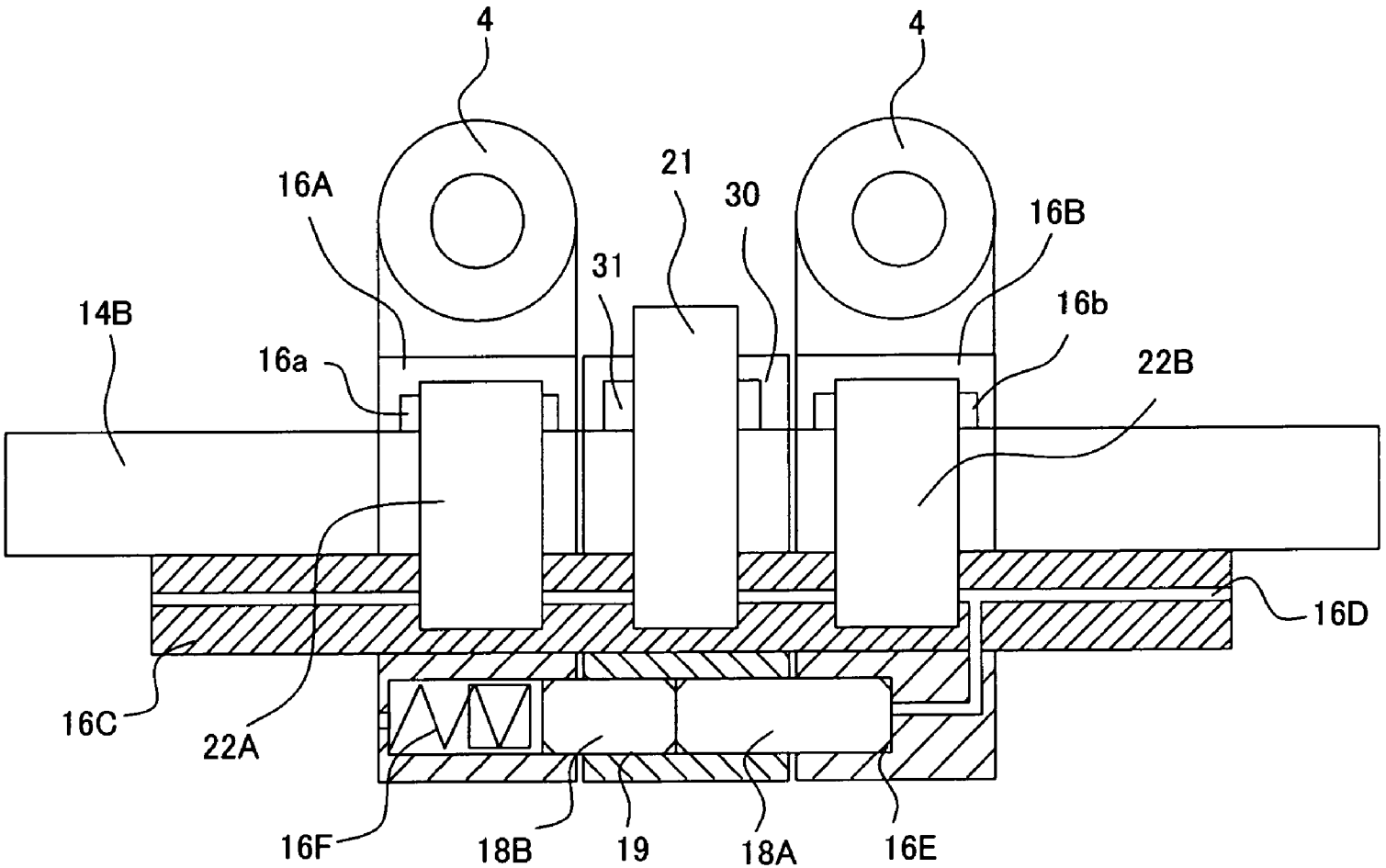
FIG. 6 is a schematic cross sectional view showing the structure, such as the rocker arm, the lost motion arm, the high-lift cam, and a low-lift cam, in a normal case of a valve-driving apparatus associated with a second embodiment of the present invention.
Figure 7:
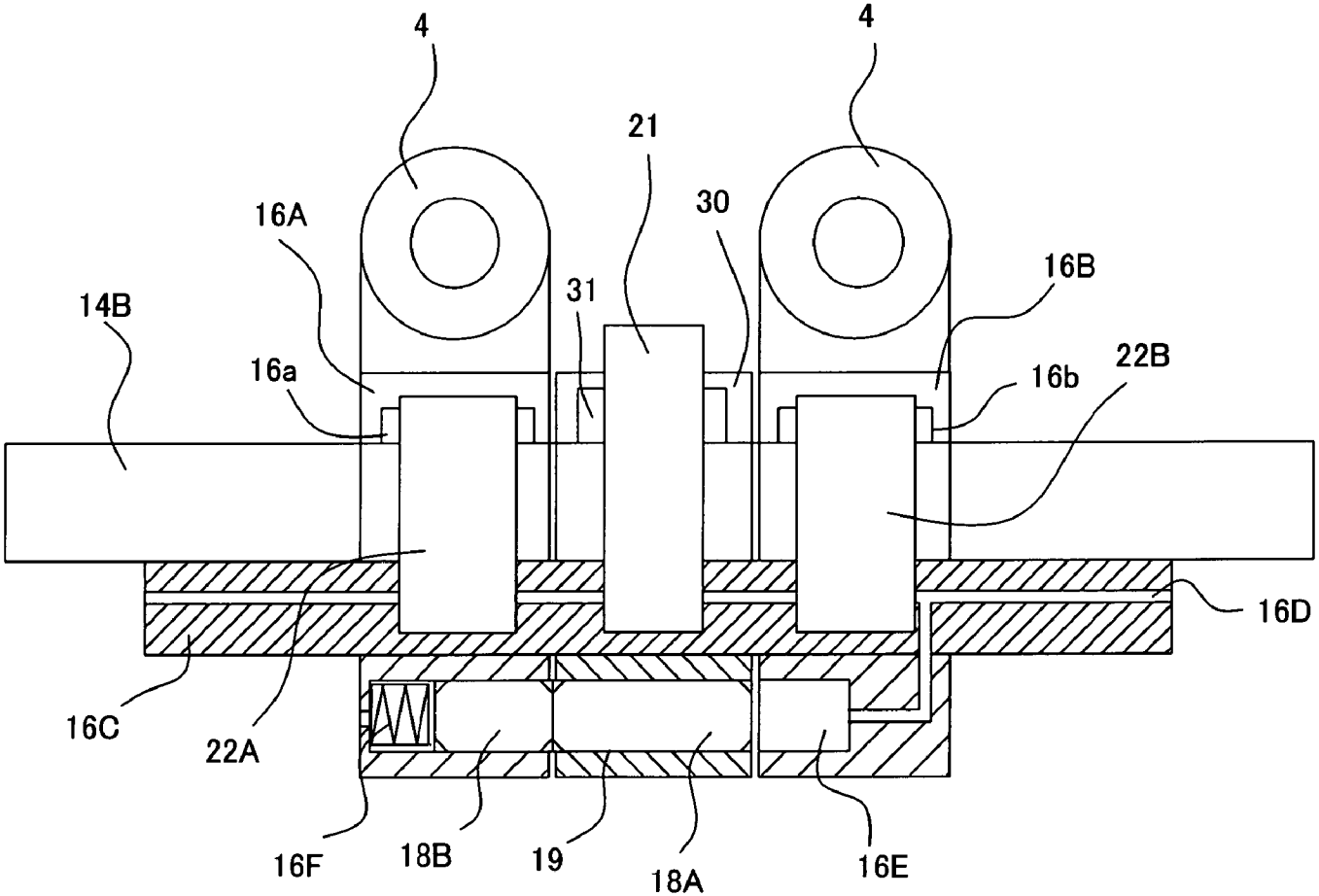
FIG. 7 is a schematic cross sectional view showing the structure, such as the rocker arm, the lost motion arm, the high-lift cam, and the low-lift cam, in an abnormal case of synchronization control of the valve-driving apparatus associated with the second embodiment of the present invention.

Next, the structure and operation of the valve-driving apparatus of the internal combustion engine in the second embodiment will be explained in detail with reference to the above-described FIG. 3, as occasion demands, in addition to FIG. 6 and FIG. 7. FIG. 6 shows the structure, such as the rocker arm, the lost motion arm, the high-lift cam, and a low-lift cam, in the normal case of the valve-driving apparatus associated with the second embodiment. FIG. 7 shows the structure, such as the rocker arm, the lost motion arm, the high-lift cam, and the low-lift cam, in the abnormal case of synchronization control of the valve-driving apparatus associated with the second embodiment. Incidentally, in explaining the second embodiment with reference to FIG. 6 and FIG. 7, the same constituent elements as those in the first embodiment carry the same reference numerals, and the explanations for them are omitted.

In the second embodiment based on the first embodiment in FIG. 6 and FIG. 7, in the abnormal case of the synchronization control, under the control of the ECU, the connection between the lost motion arm 30 and the rocker arms 16A and 16B on the both sides thereof is released. Thus, it is possible to open or close the intake valves 4 or the exhaust valves 5 by low-lift cams 22A and 22B through the rocker arms 16A and 16B on the both sides thereof. The other structures and operations associated with the second embodiment are the same as those in the first embodiment.

The valve-driving apparatus associated with the second embodiment shown in FIG. 6 and FIG. 7 is provided with the low-lift cams 22A and 22B in addition to the constituent elements in the first embodiment. The low-lift cams 22A and 22B are set to have either a cam profile for generating the high torque in a low speed rotation range of the internal combustion engine or a cam profile of a type which enhance fuel consumption. For example, the low-lift cams 22A and 22B are low-speed type output cams having a cam lift amount relatively smaller than that of the high-lift cam 21. The low-lift cams 22A and 22B are disposed parallel to the high-lift cam 21 along with the same camshaft 14B.

Next, with reference to FIG. 6 and FIG. 7, the operation of the valve-driving apparatus in the second embodiment will be explained.

As shown in FIG. 6, in the normal case, as operated in the same manner as in the first embodiment, the lost motion arm 30 and the rocker arms 16A and 16B on the both sides thereof are connected and unified in one body. Then, at a valve timing according to the cam profile of the high-lift cam 21, it is possible to open or close the intake valves 4 or the exhaust valves 5.

As shown in FIG. 7, in the abnormal case of the synchronization control, as operated in the same manner as in the first embodiment, the connection between the lost motion arm 30 and the rocker arms 16A and 16B located on the both sides thereof is released, and the rotational motion of the high-lift cam 21 is absorbed into the not-illustrated lost motion spring which supports the lost motion arm 30 and not transmitted to the locker arms 16A and 16B which abut on the intake valves 4 or the exhaust valves 5. Particularly in the second embodiment, as opposed to the first embodiment, if the connection between the lost motion arm 30 and the rocker arms 16A and 16B, which abut on the intake valves 4 or the exhaust valves 5, is released, the rotational motion of the low-lift cams 22A and 22B is transmitted to the rocker arms 16A and 16B because they always abut on the low-lift cams 22A and 22B through rollers 16*a* and 16*b*. Then, at a valve timing according to the cam profile of low-lift cams 22A and 22B, it is possible to open or close the intake valves 4 or the exhaust valves 5.

As described above, according to the valve-driving apparatus in the second embodiment, it is possible to drive the intake valves or the exhaust valves quickly, at a proper timing, and by a low lift amount if there is an abnormality in the synchronization control, which allows a safe evacuation run.

Incidentally, a specific detection method of detecting an abnormality in the synchronization control and a specific low lifting control method for the intake valves or the exhaust valves in the abnormal case of the synchronization control in the above-explained first embodiment will be described later (refer to FIG. 11 and FIG. 13 or the like).

(Third Embodiment)

Next, the structure and operation of the valve-driving apparatus of the internal combustion engine in the third embodiment will be explained in detail with reference to FIG. 8 and FIG. 9.

Firstly, with reference to FIG. 8 and FIG. 9, the structure of the valve-driving apparatus provided with a finger-follower-type arm portion in the third embodiment will be explained in detail. FIG. 8 shows the constituent elements of the valve-driving apparatus associated with the third embodiment, i.e. a Hydraulic Lash Adjuster (HLA), the rocker arm, the roller, a nose, and the intake valve. FIG. 9 shows the detailed structure of the HLA of the valve-driving apparatus associate with the third embodiment.

Figure 8:
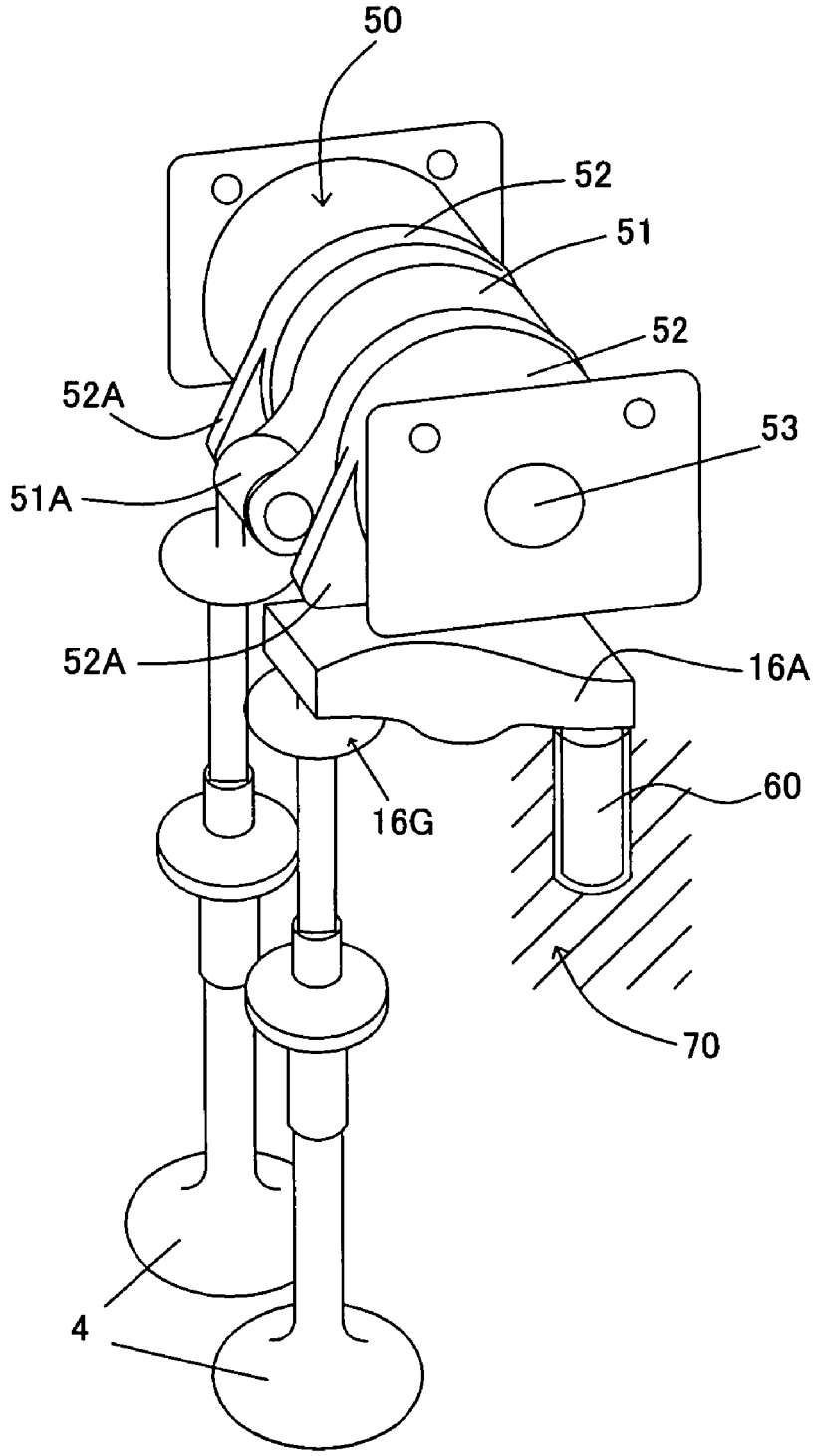
FIG. 8 is a perspective view showing the constituent elements of a valve-driving apparatus associated with a third embodiment of the present invention, i.e. a Hydraulic Lash Adjuster (HLA), the rocker arm, a roller, a nose, and the intake valve.
Figure 9:
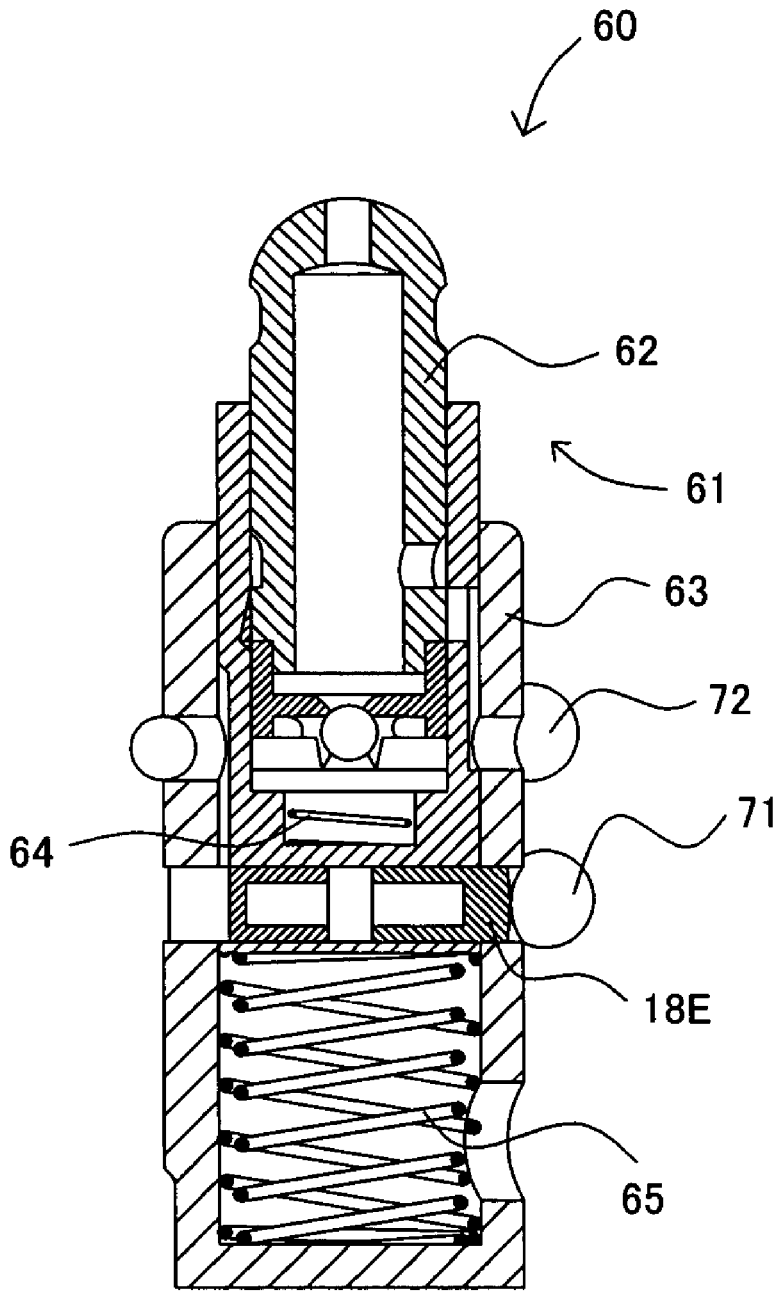
FIG. 9 is a schematic cross sectional view showing the detailed structure of the HLA, which is one example of the valve-driving apparatus associate with the third embodiment of the present invention.

The valve-driving apparatus associated with the third embodiment shown in FIG. 8 and FIG. 9 is broadly provided with: HLAs 60; the rocker arms 16A; a valve-characteristics adjusting mechanism 50; the intake valves 4; and a cylinder head 70.

The HLA 60 is provided with: a pivot portion 61; a piston 62; a guide portion 63; a lock pin 18E; a compression spring 64; and a lost motion spring 65.

The rocker arm 16A abuts on the pivot portion 61 of the HLA 60 on one end side and abuts on the upper end of a valve rod of the intake valve 4 at a valve contact portion 16G placed on the bottom surface on the other end side. It also abuts on a nose 52A of the valve-characteristics adjusting mechanism 50 on the top surface on the other end side.

The valve-characteristics adjusting mechanism 50 is provided with a first ring 51; a roller 51A; second rings 52; noses 52A; and a support shaft 53.

Each of the intake valves 4 abuts on the valve contact portions 16G placed on the bottom surface of respective one of the rocker arms 16A as described above.

The cylinder head 70 is provided with an oil channel 71. Particularly, the cylinder head 70 is disposed around the HLA 60 and forms an oil channel 72 through which a fluid is communicated with an engine oil channel that is different from another channel connected with the oil channel 71 for the periodic operation of HLA 60. The oil channel 71 has a known "pressure fluid source" required to operate the HLA in the third embodiment. Therefore, it is possible to control an oil pressure by using a not-illustrated electromagnetic valve or the like in the oil channel 71, and it is possible to selectively generate a relatively low pressure or a relatively high pressure.

Next, with reference to FIG. 8 and FIG. 9, the operation in addition to the detailed structure in the third embodiment will be explained.

As shown in FIG. 9, in the normal case, the oil channel 71 has a relatively low pressure, so that the lock pin 18E is moved outward and the piston 62 and the guide portion 63 are connected under the control of the ECU. Thus, the pivot portion 61 is fixed, and the vertical movement of the pivot portion 61 is not performed. Thus, the rotational motion of the cam is transmitted to the intake valve 4 through the roller 51A, the first ring 51, the second ring 52, the nose 52A, and the rocker arm 16A in sequence, without a play (space gap) at a contact portion between the rocker arm 16A and the nose 52A, by operation of the HLA 60 provided therein with the compression spring 64. This enables the intake valve 4 to be opened or closed.

More specifically, as shown in FIG. 8, the valve-characteristics adjusting mechanism 50 is provided with: the support shaft 53; the first ring 51 disposed on the support shaft 53; and two second rings 52 disposed on the both sides thereof. The support shaft 53 is fixedly mounted on the cylinder head 70 or the like of the internal combustion engine 1. The first ring 51 and the second rings 52 are supported swingably or oscillatably in the circumferential direction around the support shaft 53. The roller 51A is rotatably mounted on the outer circumference of the first ring 51, and the nose 52A is formed on the outer circumference of the second ring 52.

The valve-characteristics adjusting mechanism 50 is mounted on the internal combustion engine 1 so that the roller 51A faces to the cam and that each nose 52A faces to one end portion of the rocker arm 16A corresponding to respective one of the intake valves 4. If the roller 51A comes in contact with a not-illustrated cam nose and is pushed down along with the rotation of the cam, the first ring 51 which supports the roller 51A rotates on the support shaft 53. The rotational motion is transmitted to the second rings 52 through the support shaft 53, and the second rings 52 rotate in the same direction as that of the first ring 51.

By the rotation of the second rings 52, each nose 52A pushes down one end portion of respective one of the rocker arms 16A, by which the intake valves 4 displace downward against not-illustrated valve springs, thereby to open the intake port.

If the not-illustrated cam nose goes over the roller 51A, the spring force of the not-illustrated valve springs pushes up the intake valves 4, thereby to close the intake port. In this manner, the rotational motion of the not-illustrated camshaft is converted into the opening or closing motion of the intake valves 4.

On the other hand, in the abnormal case of the synchronization control, the oil channel 71 has a relatively high pressure, so that the lock pin 18E is moved inward and the connection between the piston 62 and the guide portion 63 is released under the control of the ECU. The piston 62 of the pivot portion 61 is made slidable by the lost motion spring 65, which makes a pivot position slidable. Although the noses 52A of the valve-characteristics adjusting mechanism 50 abut on the rocker arms 16A, the rotational motion of the cam is not transmitted to the intake valves 4 because the pivot position at the rocker arm 16A reciprocate. Then, the opening or closing of the intake valves 4 is stopped.

As described above, according to the valve-driving apparatus in the third embodiment, it is possible to stop the intake valves or the exhaust valves quickly and at a proper timing if there is an abnormality in the synchronization control, which allows a safe evacuation run.

Incidentally, a specific detection method of detecting an abnormality in the synchronization control as well as a specific stop controlling method of controlling the stop of the intake valves or the exhaust valves in the abnormal case of the synchronization control in the above-explained third embodiment will be described later (refer to FIG. 11 and FIG. 12 or the like).

(Fourth Embodiment)

Next, the structure and operation of the valve-driving apparatus of the internal combustion engine in the fourth embodiment will be explained in detail with reference to FIG. 10A and FIG. 10B.

Firstly, with reference to FIG. 10A and FIG. 10B, the structure of the valve-driving apparatus in the fourth embodiment will be explained in detail. FIG. 10A and FIG. 10B show the structure and operation of the constituent elements of the valve-driving apparatus associated with the fourth embodiment, i.e. first and second links, a coil spring, a lock pin, and the intake valve, where FIG. 10A is a side view and FIG. 18B is a front view.

Figure 10B:
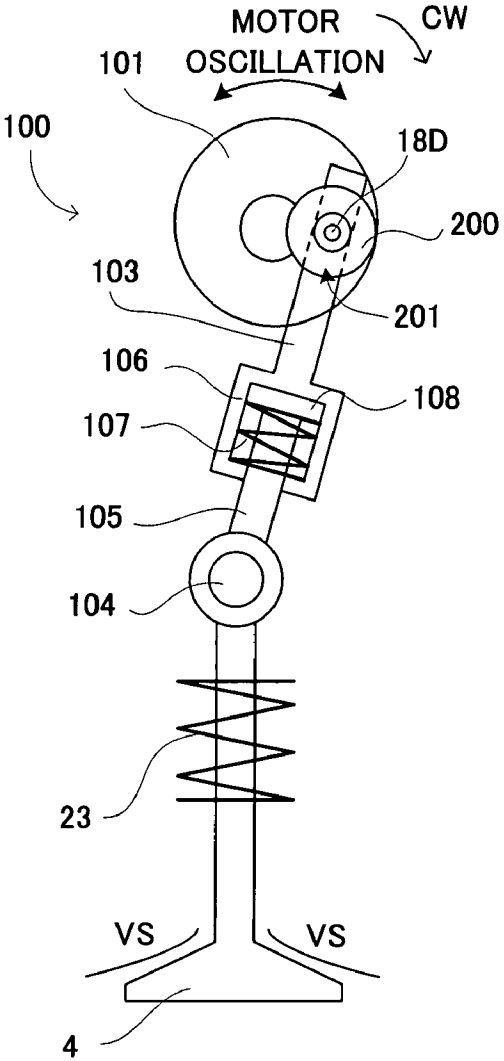
FIG. 10B is a schematic front view showing the structure and operation of the constituent elements of the valve-driving apparatus associated with the fourth embodiment of the present invention, i.e. the first and second links, the coil spring, the lock pin, and the intake valve.
Figure 10A:
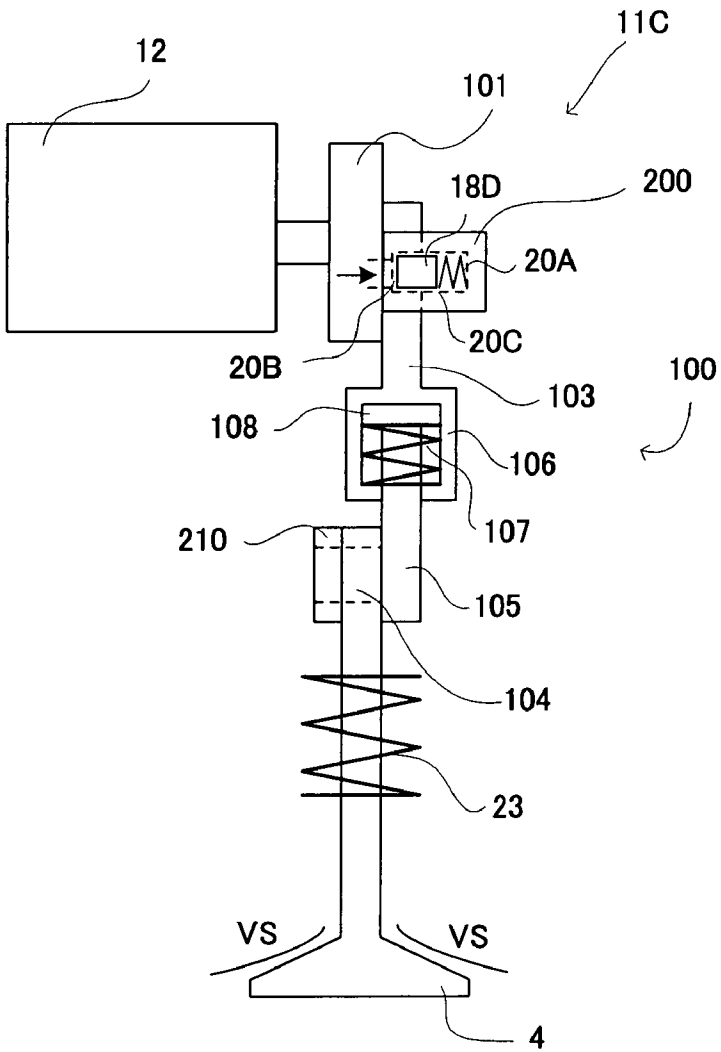
FIG. 10A is a schematic side view showing the structure and operation of the constituent elements of a valve-driving apparatus associated with a fourth embodiment of the present invention, i.e. first and second links, a coil spring, a lock pin, and the intake valve.

A valve-driving apparatus 11C of the internal combustion engine associated with the fourth embodiment shown in FIG. 10A and FIG. 10B uses a link mechanism to drive the intake valve 4 or the exhaust valve 5 opened or closed with respect to a valve seat VS. The valve-driving apparatus 11 is provided with: the electric motor 12 as a drive source; and a power transmission mechanism 100 for converting the rotational motion of the motor 12 into the opening or closing motion of the intake valves 4. The power transmission mechanism 100 has: an eccentric plate 101 as a rotating member which is rotationally driven by the motor 12; a first link 103 which is rotatably connected through a first bearing 200 to a connection position which is off-centered from the center of rotation of the eccentric plate 101; and a second link 105 which is rotatably connected through a connection pin 104 of a second bearing 210 to the upper end portion of the intake valve 4. Particularly, the eccentric plate 101 and the first link 103 are connected by a lock pin 18D and a return spring 20A, which will be described later, in the normal case, and they function as a crank mechanism for converting the rotational motion of the motor 12 into reciprocating motion. The combination between the first link 103 and the second link 105 constitutes the link mechanism.

A guide tube 106 is disposed on the end of the fist link 103 which accommodates therein a coil spring 107 and a slider 108 for holding the coil spring 107. The coil spring 107 is accommodated inside the guide tube 106 in somewhat compressed condition so as to press the slider 108 against the end face inside the guide tube 106. The end portion of the second link 105 is inserted into the guide tube 106 and connected to the slider 108. By this, the power transmission mechanism 100 is constructed as a slider crank mechanism which is one type of the link mechanism.

Next, with reference to FIG. 10A and FIG. 10B, the operation in the normal case of the valve-driving apparatus 11C in the fourth embodiment will be explained in detail.

As shown in FIG. 10A and FIG. 10B, in the normal case, the lock pin 18D, which is disposed inside the first bearing 200, is linked to an linkage hole 20C of the first link 103 by an elastic force of the return spring 20A, and thus, the first link 103 and the eccentric plate 101 are connected through the first bearing 200. The rotational motion of the electric motor 12 is transmitted to the intake valve 4 by the link mechanism, which enables the intake valve 4 to be opened or closed.

More specifically, in the case where the connection position of the eccentric plate 101 and the first link 103 is such as shown in FIG. 10A and FIG. 10B, if the intake valve 4 comes into intimate contact with the valve seat VS and the slider 108 abuts against the upper end inside the guide tube 106, the slider 108 is pushed down by the guide tube 106 by rotating the eccentric plate 101 clockwise in FIG. 10B (in the direction of an arrow CW) from the connection position. By transmitting the motion to the intake valve 4 through the second link 105, it is possible to open the intake valve 4. The lift amount of the intake valve 4 from the valve seat VS correlates with an angle of rotation of the eccentric plate 101 from the reference position as shown in FIG. 10A. If the angle of rotation increases, the lift amount increases.

On the other hand, in the abnormal case of the synchronization control, pressure oil is led to a hydraulic chamber 20B in which the lock pin 18D is stored, and an oil pressure acts on the lock pin 18D, under the control of the ECU. The lock pin 18D is pushed to the right direction by a predetermined amount against the elastic force of the return spring 20A, and thus, the connection between the first link 103 and the first bearing 200 is released. This causes a guide hole 201 inside the first bearing 200 to be slidable, i.e. in a lost motion condition. The connection between the first link 103 and the eccentric plate 101 is released, and the rotational motion of the motor is not transmitted to the intake valve 4. Thus, the intake valve 4 is not opened nor closed.

Incidentally, a specific detection method of detecting an abnormality in the synchronization control and a specific stop controlling method of controlling the stop of the intake valves or the exhaust valves in the abnormal case of the synchronization control in the above-explained fourth embodiment will be described later (refer to FIG. 11 and FIG. 12 or the like).

(Electronic Control Unit (ECU))

Next, the structure of the ECU for controlling the internal combustion engine and the valve-driving system for the internal combustion engine, which is common to the first to fourth embodiments associated with the present invention, will be explained in detail with reference to FIG. 11. FIG. 11 shows the ECU for controlling the internal combustion engine and the valve-driving system for the internal combustion engine associated with the present invention, various sensors, various actuators, or the like.

An ECU 6 is a one-chip micro computer having therein a Control Processing Unit (CPU); a Read Only Memory (ROM); a Random Access Memory (RAM); a backup RAM; or the like. The CPU overall controls the internal combustion engine in a normal driving case according to a program recorded in the ROM. Moreover, the ECU 6 constitutes one example of the "judging device", the "fail-safe device", and the "rotation-number determining device", and controls the lost motion arm 30 or the like which constitutes the "transmitting device" associated with the present invention, as described above.

Specifically, the ECU 6 is connected through electric wiring to: a cam angle sensor (a phase angle difference detection sensor) 14C; a crank angle sensor (an engine revolution sensor) 40 mounted on the internal combustion engine 1, each of which constitutes one example of the "rotation-number determining device"; and other sensors, such as an accelerator position sensor and a vehicle speed sensor, which are not illustrated. Moreover, the ECU 6 is connected through electric wiring to: a connection/separation transmission mechanism 80 including the lock pins 18A and 18B, the rocker arms 16A and 16B, the lost motion arm 30, or the like which constitute one example of the "linkage-separating device"; and other actuators.

In the normal driving case and in the abnormal case of the synchronization control between the cam rotation and the crank rotation, the ECU 6 generates predetermined types of various control signals, with the output signals (i.e. electrical signals) of the various sensors as input parameters for a program set in advance. The ECU 6 controls, with the various control signals, the timing of connection or release of the connection by the connection/separation transmission mechanism 80 as well as the drive amount of the other actuators.

The ECU 6 is provided with a backup RAM 7 for storing therein the number of rotations of the crankshaft, the number of rotations of the camshaft, or the required torque, of each cylinder 2 on driving of the internal combustion engine 1, and for calculating a difference in quantity between the target number of rotations of the camshaft and the actual number of the rotations of the camshaft.

As the target-cam-rotation-number calculating device, the ECU 6 calculates the target number of rotations of the camshaft, according to the measured number of rotations of the crankshaft, i.e. the number of engine revolutions, and the required torque of the internal combustion engine obtained from the various sensor amounts. The target number of rotations of the camshaft is uniquely determined, with the number of rotations of the crankshaft and the required torque of the internal combustion engine as parameters. Such unique determination is quickly performed on the basis of obtainment from a table made in advance or in accordance with calculation by using a predetermined function, for example.

The crank angle sensor 40 constitutes, with other sensors, one example of the "rotation-number detecting device" or the "target-cam-rotation-number calculating device" associated with the present invention, and detects the present crank angle or rotational angular velocity of the crankshaft. More specifically, the crank angle sensor 40 is a magnetic sensor or the like which is capable of detecting an object (e.g. metal or the like) and is disposed at a predetermined position in the vicinity of the not-illustrated crankshaft inside the internal combustion engine 1. Namely, a gear having a concavo-convex pattern formed on its outer circumference (hereinafter referred to as a "signal rotor") is mounted at the predetermined position on the crankshaft. The crank angle sensor 40 is disposed at a position where the number of teeth of the signal rotor can be detected. The crank angle sensor 40 is capable of detecting the crank angle at a resolution of about 10 to 30 degrees, for example. If the crankshaft rotates, the signal rotor rotates in conjunction with the crankshaft rotation. At this time, the crank angle sensor 40 detects the number of teeth of the signal rotor and outputs it to the ECU 6 or the like as a pulse signal. The ECU 6 counts the pulse signal outputted from the crank angle sensor 40 and converts it into the crank angle. In this manner, the ECU 6 or the like detects the crank angle. The crank angle sensor 40 is capable of detecting the crank angle as an absolute angle because it is disposed directly inside the internal combustion engine 1.

The cam angle sensor 14C constitutes one example of the "rotation-number detecting device", and more specifically, the "cam-rotation-number measuring device" associated with the present invention, and is provided for each intake valves 4 or exhaust valves 5 of each identical cylinder 2. For example, in the above-described FIG. 1, two cam angle sensors 14C in total, i.e. one for the camshaft that drives the intake valves 4 and the other for the camshaft that drives the exhaust valves 5, are provided in each cylinder. If there are four cylinders, 2×4=8 cam angle sensors 14C are provided. According to the cam angle sensor 14C, it is possible to learn the present cam angle and rotational angular velocity of the camshafts 14A and 14B which control the opening or closing timing of the exhaust valves 5 and the intake valves 4.

In the above manner, the ECU 6 is capable of judge or determine whether or not there is an abnormality in the synchronization control, on the basis of information from the crank angle sensor 40 and the cam angle sensor 14C, i.e. the information about the present crank angle and rotational angular velocity of the crankshaft and the information about the present cam angle and rotational angular velocity of the camshafts which control the opening or closing timing of the exhaust valves 5 and the intake valves 4. As explained next, if it is judged that there is an abnormality in the synchronization control, it is possible to operate the lock pin which constitutes one example of the connection/separation transmission mechanism 80 by an oil pressure or an electromagnetic force, thereby to stop the intake valve or the exhaust valve, or to change the lift amount to be low (refer to FIG. 12 and FIG. 13).

(Control Method in Abnormal Case of Synchronization Control)

Figure 12:
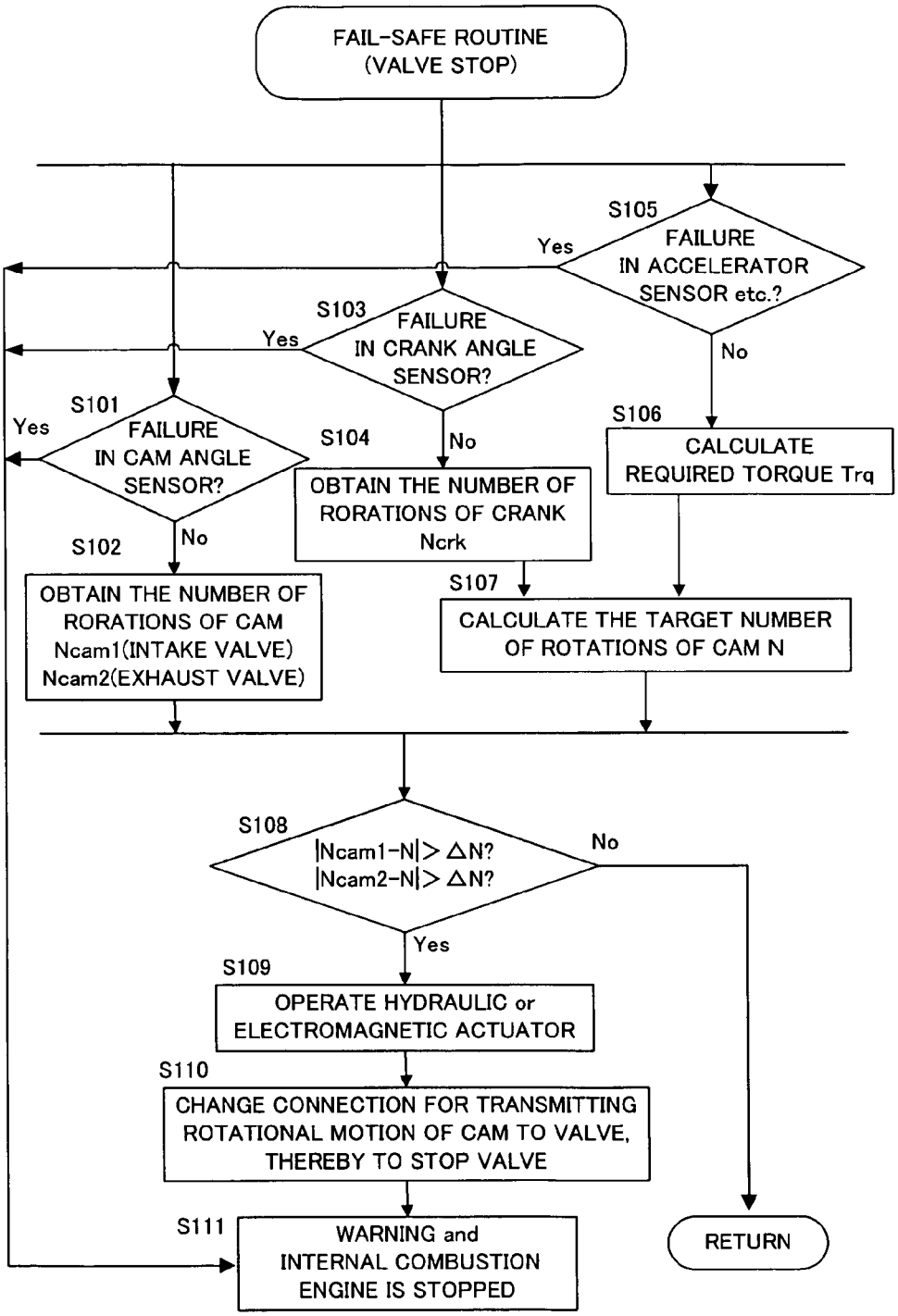
FIG. 12 is a flowchart showing a fail-safe processing routine in abnormality in synchronization control associated with the first, third, and fourth embodiments of the present invention.

With reference to FIG. 12, the fail-safe processing in the abnormal case of the synchronization control, which is controlled by the ECU associated with the first, third, and fourth embodiments, will be explained hereinafter. FIG. 12 shows a fail-safe processing routine in the abnormality in the synchronization control associated with the embodiments. The fail-safe processing routine is a routine stored in the ROM of the ECU in advance and a routine performed mainly by the ECU regularly or irregularly during the operation of the internal combustion engine 1. Preferably, the routine is repeated at intervals of a sufficiently short time compared to that for an engine stroke (e.g. of the order of several msec or several μsec), by which it is possible to prevent an engine failure caused by the contact or collision between the piston and the valve or the like, even if there is an abnormality in the synchronization control.

In FIG. 12, at first, it is judged or determined whether or not the cam angle sensor 14C has a failure, under the control of the ECU 6 (step S101). Such a judgment is performed in the ECU 6 with the output signal of the cam angle sensor 14C as a parameter, for example. If the cam angle sensor 14C does not have a failure (the step S101: No), the number of rotations of the cam corresponding to the intake valves 4 "Ncam1" and the number of rotations of the cam corresponding to the exhaust valves 5 "Ncam2" are measured by the cam angle sensor 14C and obtained by the ECU 6 (step S102).

At the same time of, or before and after the steps S101 and S102, it is judged whether or not the crank angle sensor 40 has a failure, under the control of the ECU 6 (step S103). Such a judgment is performed in the ECU 6 with the output signal of the crank angle sensor 40 as a parameter, for example. If the crank angle sensor 40 does not have a failure (the step S103: No), the number of rotations of the crank "Ncrk" is measured by the crank angle sensor 40 and obtained by the ECU 6 (step S104).

At the same time of, or before and after the steps S101 and S102 as well as the steps S103 and S104, it is judged whether or not the other sensors, such as the accelerator position sensor, have failures, under the control of the ECU 6 (step S105). Such a judgment is performed in the ECU 6 with the output signals of the accelerator position sensor and the like as parameters, for example. If the accelerator position sensor and the like do not have failures (the step S105: No), the required torque "Trq" is calculated by the ECU 6 on the basis of measured values obtained by the accelerator position sensor and the like (step S106).

Then, the target number of rotations of the cam "N" is calculated, under the control of the ECU 6, from the number of rotations of the crank "Ncrk" obtained in the step S104 and the required torque "Trq" calculated in the step S106 (step S107).

If the processing in the steps S101 and S102, the processing in the steps S103, S104, and S107, and the processing in the steps S105 to S107, as described above, are completed, then, the difference in quantity "ΔN1" between the number of rotations of the cam corresponding to the intake valves 4 "Ncam1" and the target number of rotations of the cam "N" is calculated under the control of the ECU 6, and it is judged whether or not the difference in quantity "ΔN1" is greater than the predetermined threshold value "ΔN". The same judgment is also performed for the difference in quantity "ΔN2" between the number of rotations of the cam corresponding to the exhaust valves 5 "Ncam2" and the target number of rotations of the cam "N" (step S108). If the difference "ΔN1" or "ΔN2" calculated in the above manner is greater than the predetermined threshold value "ΔN" (the step S108: Yes), it is considered that there is an abnormality in the synchronization control. Under the control of the ECU 6, the various actuators for generating an oil pressure or an electromagnetic force are operated, and the oil pressure or the electromagnetic force acts on the connection/separation transmission mechanism 80, such as the lock pin and the like (step S109).

Then, the rotational motion of the cam is not transmitted to the intake valves 4 or the exhaust valves 5, by the connection/separation transmission mechanism 80, such as the lost motion arm. The intake valves 4 or the exhaust valves 5 are not driven open or closed but stopped (step S110).

Then, a warning lamp to a driver or the like starts to flash, and the interval combustion engine 1 is stopped (step S111).

On the other hand, as a result of the judgment in the steps S101, S103, and S105, if the various sensors have failures (the step S101: Yes, the step S103: Yes, and the step S105: Yes), the warning lamp to a driver or the like also starts to flash, and the interval combustion engine 1 is stopped (the step S111). Incidentally, in these cases, the judgment about the abnormality in the synchronization control (the step S108) is not performed.

On the other hand, as a result of the judgment in the step S108, if the above-described difference is less than or equal to the predetermined threshold value "ΔN" (the step S108: No), it is considered that there is not any abnormality in the synchronization control, and one cycle of the fail-safe processing routine is ended.

Incidentally, the first, third, and fourth embodiments in FIG. 12 are constructed to perform the valve stop (the step S109 and the step S110) and then to perform the warning and the stop of the internal combustion engine (the step S111), once the abnormality in the synchronization control occurs (the step S108: Yes). However, they may be constructed to perform the normal operation again after the step S110. Even if the abnormality in the synchronization control occurs once, in the case where the abnormality in the synchronization control is suddenly detected because of an signal error or the like and where there is not any abnormality in the valve-drive mechanism (refer to FIG. 1 to FIG. 10 or the like), it is unnecessary to repair the engine. Thus, in this type of case, it is significant to try to continue the normal operation.

Figure 13:
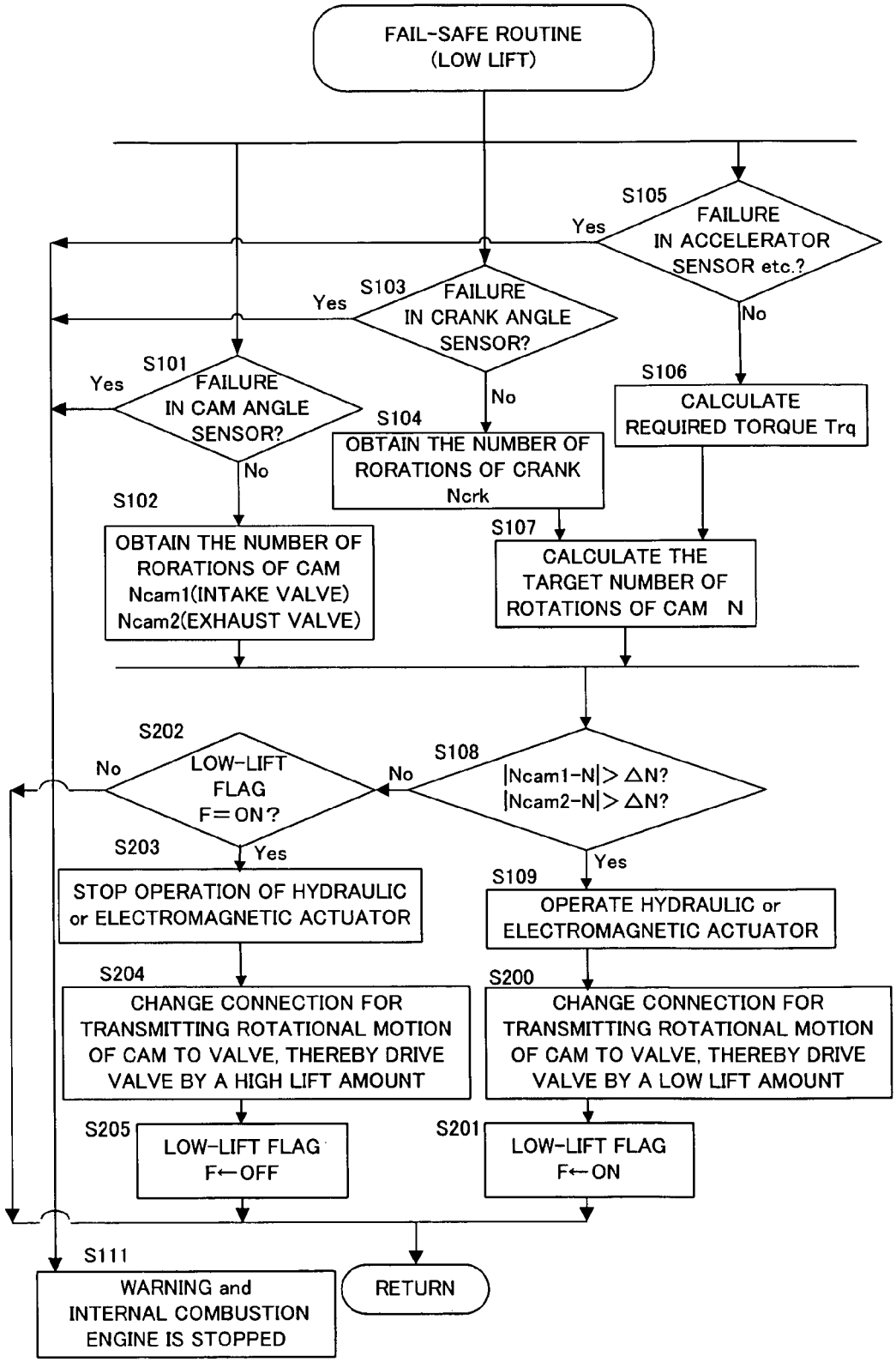
FIG. 13 is a flowchart showing a fail-safe processing routine in abnormality in synchronization control associated with the second embodiment of the present invention.

With reference to FIG. 13, the fail-safe processing in the abnormal case of the synchronization control, which is controlled by the ECU associated with the second embodiment, will be explained hereinafter. FIG. 13 shows a fail-safe processing routine in the abnormality in the synchronization control associated with the second embodiment. The fail-safe processing routine is performed mainly by the ECU 6, and the structure of the ECU 6 or the like is the same as in the case of the above-described fail-safe processing routine associated with the first, third, and fourth embodiments. Incidentally, in FIG. 13, the same steps as those in FIG. 12 which shows the fail-safe processing routine associated with the first, third, and fourth embodiments carry the same reference numerals, and the explanations for them are omitted.

In FIG. 13, the steps S101 to S109 are the same as in FIG. 12 which shows the above-described fail-safe processing routine associated with the first, third, and fourth embodiments.

In particular, in the fail-safe processing shown in FIG. 13, in the judgment in the step S108, if it is judged that there is an abnormality in the synchronization control (the step S108: Yes), after the operation of the various actuators is performed (the step S109), the rotational motion of the high-lift cam 21 is not transmitted to the intake valves 4 or the exhaust valves 5, but the rotational motion of the low-lift cams 22A and 22B is transmitted to the intake valves 4 or the exhaust valves 5 by the connection/separation transmission mechanism 80, such as the lost motion arm. The intake valves 4 or the exhaust valves 5 are opened or closed by a low lift amount (step S200).

Then, "On" is substituted into a low-lift flag "F" (step S201), and one cycle of the fail-safe processing routine is ended.

On the other hand, as a result of the judgment in the step S108, if the above-described difference "ΔN1" or "ΔN2" between the calculated number of rotations of the cam "Ncam1" or "Ncam2" and the target number of rotations of the cam "N" is less than or equal to the predetermined threshold value "ΔN" (the step S108: No), it is considered that there is not any abnormality in the synchronization control, and further it is judged whether or not the low-lift flag "F" is "On" (step S202). If the low-lift flag "F" is "On" (the step S202: Yes), the operations of the various actuators for generating an oil pressure or an electromagnetic force are stopped under the control of the ECU 6. The oil pressure or the electromagnetic force does not act on the connection/separation transmission mechanism 80, such as the lock pin, but the elastic force of the return spring 16F or the like acts thereon. Thus, for example, the rocker arms 16A and 16B and the lost motion arm 30 or the like are connected and unified in one body (step S203).

Then, for example, the rotational motion of the low-lift cam 21 is not transmitted to the intake valves 4 or the exhaust valves 5, but the rotational motion of the high-lift cams 22A and 22B is transmitted to the intake valves 4 or the exhaust valves 5 by that the rocker arms 16A and 16B and the lost motion arm 30 or the like are unified in one body. The intake valves 4 or the exhaust valves 5 are opened or closed by a high lift amount (step S204). Namely, even if the abnormality in the synchronization control occurs once and the low flag is made "On", in the case where the abnormality in the synchronization control is suddenly detected because of an signal error or the like and where there is not any abnormality in the valve-drive mechanism (refer to FIG. 1 to FIG. 10 or the like), it is possible to return to a condition to perform the normal operation after the processing in the steps S202 to S204.

Then, "Off" is substituted into the low-lift flag "F" (step S205), and one cycle of the fail-safe processing routine is ended.

On the other hand, as a result of the judgment in the step S202, if the low-lift flag "F" is not "On" (the step S202: No), one cycle of the fail-safe processing routine is ended without change. Namely, since there is not any abnormality in the synchronization control in the previous cycle of the fail-safe processing routine, it is possible to continue the normal operation.

On the other hand, as a result of the judgment in the steps S101, S103, and S105, if the various sensors have failures (the step S101: Yes, the step S103: Yes, and the step S105: Yes), the warning lamp to a driver or the like starts to flash, and the internal combustion engine 1 is stopped (the step S111), as in FIG. 12 which shows the fail-safe processing routine associated with the first, third, and fourth embodiments.

The first to forth embodiment is explained mainly as what drives the intake valves 4, but the same structure may be used even in the case of driving the exhaust valves 5.

In the first and second embodiment, the valve stop or the change to the low-lift cams is realized by operating the oil pressure onto the lock pin, while the change to the opening or closing drive by the high-lift cam of the intake valves or the exhaust valves is realized by not operating the oil pressure onto the lock pin. However, the opposite structure and operation may be adopted in accordance with characteristics required for the internal combustion engine.

In the first to forth embodiment, the oil pressure of lubricating oil is used for the movement of the lock pin 18A to 18E to change the connection/separation transmission mechanism 80, but the pressure of other fluids (liquid or air), the electromagnetic force, or the like may be used.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and range of equivalency of the claims are therefore intended to be embraced therein.

The entire disclosure of Japanese Patent Application No. 2003-288275 filed on Aug. 6, 2003 including the specification, claims, drawings and summary is incorporated herein by reference in its entirety.

What is claimed is:

1. A valve-driving system for an internal combustion engine comprising:

an electric motor for generating a rotational driving force to drive a valve for intake or exhaust mounted on a cylinder in the internal combustion engine so as to open and close the valve in synchronization with a piston motion in the internal combustion engine;

a transmitting device capable of changing between (i) a first condition to transmit therethrough the rotational driving force to the valve from said electric motor and (ii) a second condition to stop an opening or closing operation of the valve or to make the valve driven by a low lift amount;

a judging device for judging whether or not synchronization between the opening or closing operation of the valve and the piston motion is abnormal; and a fail-safe device for changing said transmitting device to the second condition if it is judged by said judging device that the synchronization is abnormal.

2. The valve-driving system according to claim 1, wherein said transmitting device comprises:

a rocker arm connected to the valve;

a lost motion arm which can be linked to the rocker arm in the first condition and which is connected to said electric motor; and a linkage-separating device for separating the lost motion arm from the rocker arm, by an oil pressure which is caused by a driving power of the internal combustion engine or an electromagnetic force which is not caused by the driving power, in the second condition.

3. A valve-driving system for an internal combustion engine comprising:

an electric motor for generating a rotational driving force to drive a valve for intake or exhaust mounted on a cylinder in the internal combustion engine so as to open and close the valve in synchronization with a piston motion in the internal combustion engine;

a rotation-number determining device for determining a target number of rotations of the internal combustion engine;

a rotation-number detecting device for detecting an actual number of rotations of the internal combustion engine; and a judging device for judging whether or not synchronization between an opening or closing operation of the valve and the piston motion is abnormal, on the basis of a difference in quantity between the determined target number of rotations and the detected actual number of rotations.

4. The valve-driving system according to claim 3, wherein said judging device judges that the synchronization is abnormal if the difference in quantity reaches to or exceeds a predetermined threshold value.

5. The valve-driving system according to claim 3, wherein said rotation-number detecting device comprises a cam-rotation-number measuring device for measuring the number of rotations of a cam of the internal combustion engine, and said rotation-number determining device comprises a target-cam-rotation-number calculating device for calculating the target number of rotations on the basis of a required torque as well as the number of engine revolutions or the number of rotations of a crankshaft of the internal combustion engine.

6. The valve-driving system for the internal combustion engine according to claim 3, wherein the internal combustion engine has a plurality of cylinders, and said valve-driving system is provided for each of the plurality of cylinders.

7. The valve-driving system according to claim 1, wherein the internal combustion engine has a plurality of cylinders, and said valve-driving system is provided for each of the plurality of cylinders.

8. The valve-driving system according to claim 1, further comprising:

a rotation-number determining device for determining a target number of rotations of the internal combustion engine; and a rotation-number detecting device for detecting an actual number of rotations of the internal combustion engine, said judging device judging whether or not the synchronization between the opening or closing operation of the valve and the piston motion is abnormal, on the basis of a difference in quantity between the determined target number of rotations and the detected actual number of rotations.

9. A valve-driving method in a valve-driving system for an internal combustion engine comprising: an electric motor for generating a rotational driving force to drive a valve for intake or exhaust mounted on a cylinder in the internal combustion engine so as to open and close the valve in synchronization with a piston motion in the internal combustion engine; and a transmitting device capable of changing between (i) a first condition to transmit therethrough the rotational driving force to the valve from said electric motor and (ii) a second condition to stop an opening or closing operation of the valve or to make the valve driven by a low lift amount, said valve-driving method comprising:

a driving process of generating the rotational driving force by said electric motor;

a judging process of judging whether or not synchronization between the opening or closing operation of the valve and the piston motion is abnormal; and a fail-safe process of changing said transmitting device to the second condition if it is judged by said judging process that the synchronization is abnormal.

10. A valve-driving method in a valve-driving system for an internal combustion engine comprising: an electric motor for generating a rotational driving force to drive a valve for intake or exhaust mounted on a cylinder in the internal combustion engine so as to open and close the valve in synchronization with a piston motion in the internal combustion engine, said valve-driving method comprising:

a rotation-number determining process of determining a target number of rotations of the internal combustion engine;

a rotation-number detecting process of detecting an actual number of rotations of the internal combustion engine; and a judging process of judging whether or not synchronization between an opening or closing operation of the valve and the piston motion is abnormal, on the basis of a difference in quantity between the determined target number of rotations and the detected actual number of rotations.

11. A power output apparatus comprising:

an internal combustion engine; and a valve-driving system for the internal combustion engine comprising: an electric motor for generating a rotational driving force to drive a valve for intake or exhaust mounted on a cylinder in the internal combustion engine so as to open and close the valve in synchronization with a piston motion in the internal combustion engine; a transmitting device capable of changing between (i) a first condition to transmit therethrough the rotational driving force to the valve from said electric motor and (ii) a second condition to stop an opening or closing operation of the valve or to make the valve driven by a low lift amount; a judging device for judging whether or not synchronization between the opening or closing operation of the valve and the piston motion is abnormal; and a fail-safe device for changing said transmitting device to the second condition if it is judged by said judging device that the synchronization is abnormal.

12. A power output apparatus comprising:

an internal combustion engine; and a valve-driving system for the internal combustion engine comprising: an electric motor for generating a rotational driving force to drive a valve for intake or exhaust mounted on a cylinder in the internal combustion engine so as to open and close the valve in synchronization with a piston motion in the internal combustion engine; a rotation-number determining device for determining a target number of rotations of the internal combustion engine; a rotation-number detecting device for detecting an actual number of rotations of the internal combustion engine; and a judging device for judging whether or not synchronization between an opening or closing operation of the valve and the piston motion is abnormal, on the basis of a difference in quantity between the determined target number of rotations and the detected actual number of rotations.

* * * * *